US012716298B2

(12) United States Patent
Keast et al.

(10) Patent No.: US 12,716,298 B2
(45) Date of Patent: Aug. 25, 2026

(54) TELESCOPING TORQUE REACTION TRACK DEVICE

(71) Applicant: Larry G. Keast, Houston, TX (US)

(72) Inventors: Larry G. Keast, Houston, TX (US); Keith J. Orgeron, Spring, TX (US)

(73) Assignee: Larry G. Keast, Houston, TX (US)

( * ) Notice: Subject to any disclaimer, the term of this patent is extended or adjusted under 35 U.S.C. 154(b) by 738 days.

(21) Appl. No.: 17/984,911

(22) Filed: Nov. 10, 2022

(65) Prior Publication Data

US 2023/0145409 A1 May 11, 2023

Related U.S. Application Data

(60) Provisional application No. 63/285,954, filed on Dec. 3, 2021, provisional application No. 63/277,994, filed on Nov. 10, 2021.

(51) Int. Cl.
*E21B 15/00* (2006.01)

(52) U.S. Cl.
CPC ..... *E21B 15/00* (2013.01)

(58) Field of Classification Search
CPC ..... E21B 15/00; E21B 3/022; E21B 7/023; E21B 7/02
See application file for complete search history.

(56) References Cited

U.S. PATENT DOCUMENTS 3,501,120 A 3/1970 Daniel, Jr.
4,865,135 A 9/1989 Moses
5,381,867 A 1/1995 Berry
5,433,279 A * 7/1995 Tessari ..... E21B 3/022 173/147
5,755,296 A 5/1998 Richardson et al.
6,199,641 B1 * 3/2001 Downie ..... E21B 19/10 173/55
8,757,277 B2 6/2014 Dekker et al.
9,574,403 B2 2/2017 Ferrari
10,094,175 B2 10/2018 Mason et al.
11,131,151 B2 9/2021 Wood
11,136,826 B2 * 10/2021 Walker ..... E21B 3/022
2005/0274508 A1 12/2005 Folk et al.
2007/0074460 A1 4/2007 Belik
2011/0203820 A1 8/2011 Marica et al.
2012/0181083 A1 * 7/2012 Fallen ..... E21B 19/166 175/40
2013/0220703 A1 8/2013 Marica et al.
2013/0341036 A1 12/2013 Flusche
2013/0341059 A1 * 12/2013 Flusche ..... E21B 7/023 173/184
2014/0000912 A1 1/2014 Bowley et al.
2018/0223884 A1 * 8/2018 Nelsen ..... F16B 2/10
2021/0010328 A1 * 1/2021 Gordon ..... E21B 3/02
2024/0318508 A1 * 9/2024 Gagne ..... E21B 15/006

* cited by examiner

*Primary Examiner* — Kipp C Wallace
(74) *Attorney, Agent, or Firm* — Kearney, McWilliams & Davis, PLLC; John M. DeBoer

(57) ABSTRACT

A track handling device having a rigid portion and a movable portion. The rigid portion includes a spreader having main support post extending therefrom. The movable portion includes a main support arm coupled with a driver arm and a follower arm. A bottom support arm end is configured with a boot suitable to couple with and support a torque track.

19 Claims, 16 Drawing Sheets

339
326b
399a
310
396
331
327b
326a
378

395
388
399b
373
379
327

339
395
399
394
375
389
390
327a
398
397
327b
396
373

373a
327

TELESCOPING TORQUE REACTION TRACK DEVICE

BACKGROUND

Field of the Disclosure

This disclosure generally relates to torque restraining devices (and related systems and methods) used with power swivels and top drives in the oil and gas industry.

Background of the Disclosure

When drilling for oil or gas, a wellbore is typically drilled using a drill bit attached to the lower end of a "drill string." The process of drilling a well typically includes a series of drilling, tripping, casing and cementing, and repeating as necessary. The process of doing well servicing on a previously drilled, completed, and producing well uses many of the same operations although rotation is only required for operations such as milling out a packer and/or sometimes for drilling the well deeper.

Normally, relatively large drilling rigs are used for these wells, which utilize a 'kelly' table and associated equipment. Rigs of this sort take up an enormous amount of surface area and are typically capable of generating rotary torques of 35,000 foot-pounds (47,460 joules) or more.

FIG. 1A shows a simplified view of a conventional drilling operation 100 using a powerful driver. A derrick 102 (or drilling rig) is configured to rotate a drill string 104 that has a drill bit 106 disposed at a lower end of the drill string 104, typically using a driver unit 110 and associated equipment. The driver unit 110 rotates the string 104 and the drill bit 106 to do drilling or milling work downhole in the wellbore 108

Near the derrick 102, a plurality of tubular members 103*a* are often stored on a pipe rack(s) 112. The pipe rack 112 is relatively near the ground, and substantially below the rig floor 115. Therefore, tubulars 103, 103*a* must be transported to the rig floor 115 joint by joint for use in drilling or servicing operations.

Pipe handling systems are utilized to transport the tubular 103 from the pipe rack 112 and present the tubular 103 to rig floor 115 for use by rig floor personnel. Such pipe handling systems are commonly available from rental companies, well servicing or drilling companies, and the like. These systems are typically known as pipe handlers or hydraulic catwalks, which are operated to move the tubular(s) 103 from a horizontal position on the catwalk 113, up an inclined ramp or V-door 114, to the rig floor in the derrick 102 where rig floor personnel can latch on with an elevator and raise the pipe to a vertical position.

The derrick structures of these large drilling rigs require high capital and operating cost, including significant transport logistics. The rigs may be assembled on site and must be capable of withstanding rotary torques and other loads.

For operations of less demand, and that do not require larger torques, a reduced-size and portable workover rig may be used. FIG. 1B shows a simplified view of a conventional drilling operation 100*a* that utilizes a workover rig 121. Such an operation may be useful where shallower depths are drilled or the formation allows easier drilling.

The rig 121 may have mast 101*a* suitable for erecting onsite, thus avoiding the need for a large derrick that requires complete assembly. The mast 101*a* may have a first portion 102*a* and a second portion 102*b* that telescope together for easy transport.

The rig 121 is positioned, and the mast 0101*a* is raised proximate the well/wellhead 122. Rotation is typically accomplished using a driver, namely, a power swivel 110, thus eliminating the need for the kelly and associated equipment. Tensioned torque reaction cables are used to react torque loads generated by the power swivel 110, which is typically supported on a hook or travelling block 116. Resultant torque from operation is reacted through an arm of the power swivel 110 coupled with a wire line or torque cable that is secured to the rig (not viewable here). In this manner, the power swivel 110 can apply torque to a tubular (e.g., 103, FIG. 1A) while moving up or down the rig with the pipestring.

Torques generated by the power swivel 110 are known to be limited, given the limited size of the rig 121. For example, a torque limit of 2500 ft-lbs (3390 joules) is typical. Even with these torque limitations, there are unwanted safety risks, hardware damage risks, or other problems. To accommodate torque management, the power swivel 110 is configured with a torque arm housing, as well as a telescoping rod. The end of the rod is coupled with a guide cable, such as via a shackle or hoop (with the cable passing therethrough.

The drawbacks of this configuration are numerous. For example, after continuous use the friction between the shackle and (wire) cable can suffer integral damage, thus causing them to break, resulting in chance of injury to personnel and/or damage to equipment. Moreover, when torque is applied on the shackle, this results in a point load against the cable, which then increases stresses resulting in eventual material failure/breaking. On top of the rig floor, the shackle bolt needs to be removed to put over the wire. This results in a safety hazard if the bolt or shackle are dropped.

For a more elegant solution, torque arm rollers may be used. FIG. 1C shows a conventional torque arm roller assembly 124 that may be coupled with a telescoping rod 123 movable within torque arm housing 122. The torque arm housing 122 may extend outward (such as laterally) from the power swivel 110. As the power swivel 110 moves up/down to accommodate position of the pipestring, the torque arm roller assembly 124 follows along the torque guide cable 117 (via sheaves or rollers 118).

The use of the torque arm roller assembly 124, while useful for managing torque reaction, is cumbersome. Every time the mast 101*a* is erected, the roller assembly 124 must be assembled and disassembled in order to receive the cable 117 therein (or if lowered, remove the cable 117 therefrom). The use of a track instead of a cable is also problematic, as the presence of a telescoping mast 101*a* is problematic at best.

A need exits for torque management that addresses these deficiencies and concerns.

The ability to increase efficiency and save operational time and expense while increasing safety leads to considerable competition in the marketplace. Achieving any ability to save time, or ultimately cost, while increasing safety leads to an immediate competitive advantage. Thus, there is a need in the art for a rig assembly useful for torque management of a power swivel that may save time and increase safety.

SUMMARY

Embodiments of the present disclosure pertain to a track handling device useful for torque management related to operation of a driver, such as a power swivel. There may be systems and methods related thereto.

Embodiments herein may pertain to a track handling device that may include either or both of a rigid portion and a movable portion.

The rigid portion may include: a spreader, and a first or main post coupled with the spreader. The main post may have a main post top end. There may be another or second post coupled with the spreader. The second post may be a support post. The support post may have a support post top end.

The rigid portion may include any number of support beams. For example, there may be a support beam coupled between the main post and the support post.

The rigid portion may include a first leg extending from the spreader. The first leg may be configured with a first hinge mount. In aspects, there may be a first support rack coupled with the main post top end and/or a second support rack coupled with the support post top end. There may be a first latch point extending from the spreader;

The movable portion may include one or more movable members or arms. For example, there may be a first or main support arm. The main support arm may include a main support arm top end and a main support arm bottom end.

There may be a second or driver arm movably coupled with the main support arm. The driver arm may be movably coupled with the rigid portion.

There may be another arm, such as a follower arm. The follower arm may be movably coupled between a main support arm top end and a main post top end.

The track handling device may include moving linkage, such as one or more turnbuckles. There may be a first turnbuckle. The first turnbuckle may be coupled between the main support arm and the spreader. The track handling device may include a boot coupler (or just 'boot'). The boot coupler may be disposed on the main support arm bottom end.

In operation, when the track handling device is in a first position, the main support arm may be in a retracted position. When the track handling device is in a second position, the main support arm may be in an extended position.

The track handling device may be part of and/or movably coupled with a support frame of a mobile unit.

Track handling device may include a track coupled with the boot coupler. The track may have a dolly or slider movably engaged therewith. An internal slider surface may be engaged with an outer track surface. The track may be tubular (including square, circular, oval, etc.).

The track may be telescopic. For example, the track may have a first track portion, and a second track portion telescopingly engaged with the first track portion. The first track portion may have a first portion dimension. The second track portion may have a second portion dimension.

The rigid portion may have other features or components, such as a second leg extending from the spreader. The second leg may be configured with a respective hinge mount. There may be a second latch point extending from the spreader. The movable portion may have a second turnbuckle coupled between the spreader and the main support arm. In aspects, the first turnbuckle may be longer than the second turnbuckle.

There may be a driver, such as a power swivel, disposed on either or both of the first support rack and the second support rack.

The boot coupler may have a boot pin therein. The boot pin may have a reference point. There may be a horizontal reference line that bisects the reference point when the main support arm is in the retracted position. The horizontal reference line may bisect the reference point within a tolerance of +/−0.5 inches when the main support arm is in the extended position.

Embodiments herein pertain to a torque management system for a drilling operation that may include one or more of: a mobile unit having a support frame; a mast movably coupled with the support frame, the mast having a first mast portion telescopingly engaged with a second mast portion; and/or a track handling device also coupled with the support frame. The track handling device may include a rigid portion and movable portion operable together.

The system may include a track having a first track portion coupled and a second track portion. The first track portion may be telescopingly engaged with the second track portion. There may be a slider movably engaged with the track. The slider may have a coupler extending therefrom. The system may include a power swivel. The power swivel may be stowed via the track handling device. The power swivel may have a torque arm configured to engage with the coupler.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
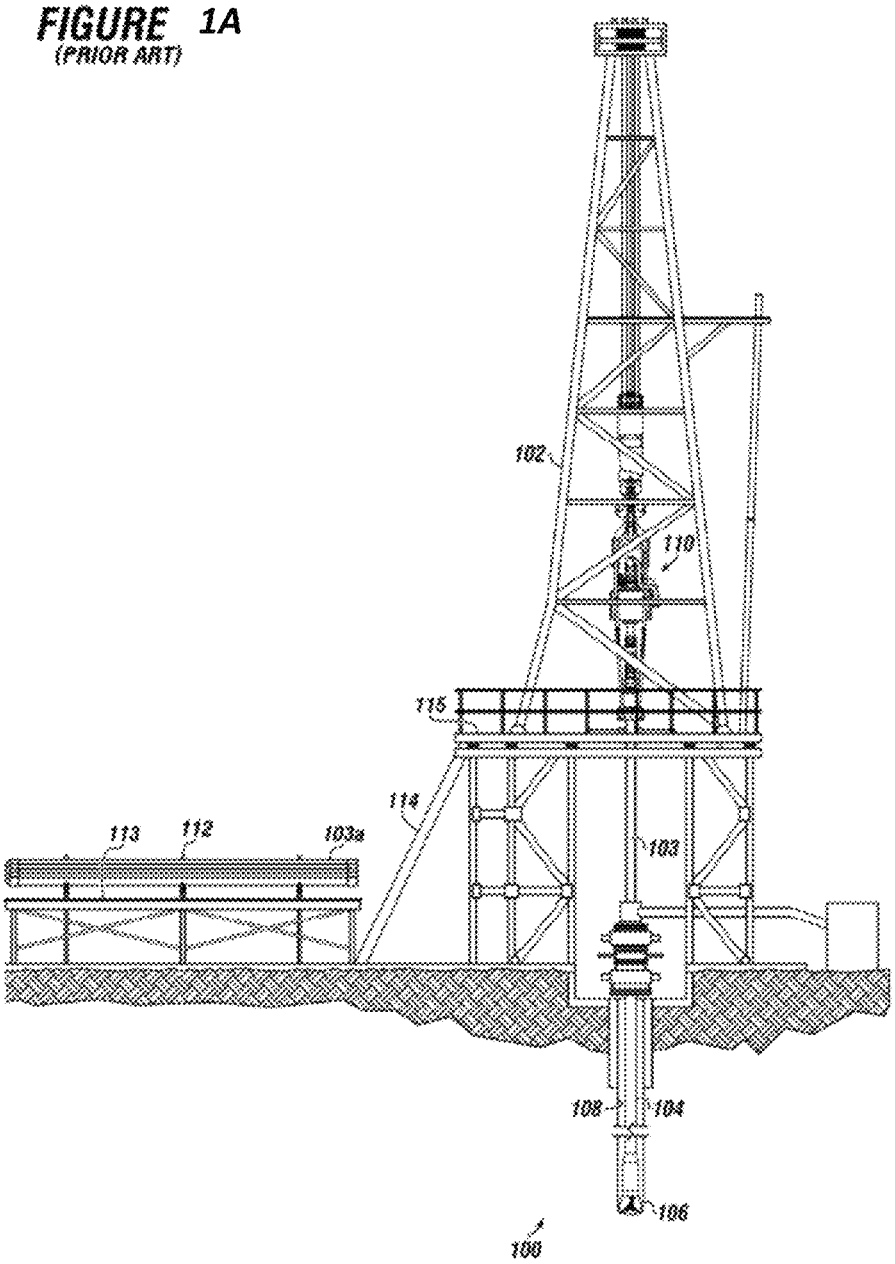
FIGURE 1A (PRIOR ART)
FIG. 1A is a side view of a process diagram of a conventional derrick operation for an oil and gas production system.
Figure 1C:
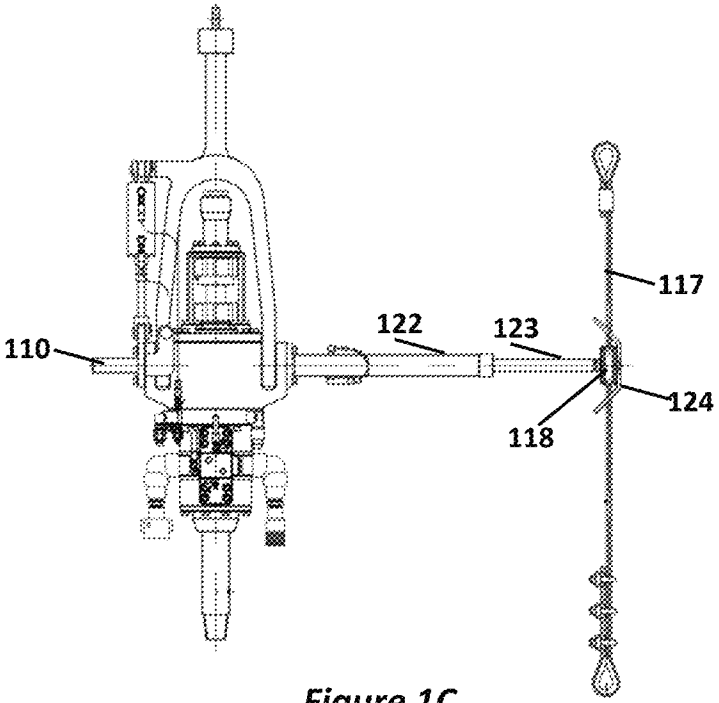
Figure 1C (Prior Art)
FIG. 1C is a side view of a process diagram of a conventional torque arm roller for a power swivel.
Figure 1B:
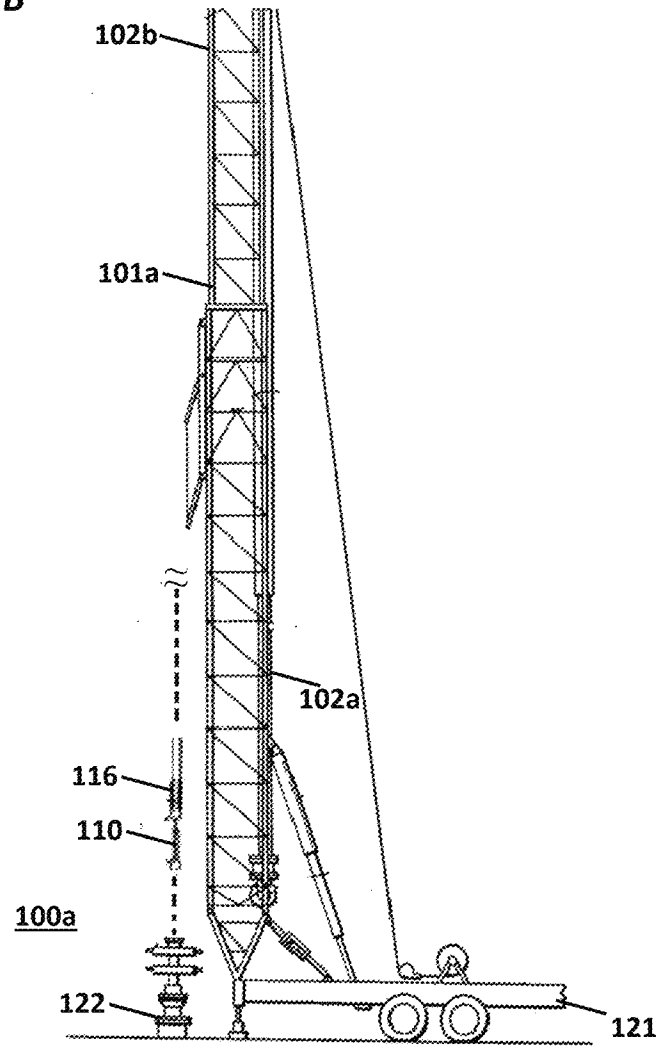
Figure 1B (Prior Art)
FIG. 1B is a side view of a process diagram of a conventional field-erected power swivel operation for an oil and gas production system.

Regardless of whether presently claimed herein or in another application related to or from this application, herein disclosed are novel apparatuses, units, systems, and methods that pertain to improved handling of tubulars, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may (but need not) be tubular in nature.

The term "composition" or "composition of matter" as used herein may refer to one or more ingredients, components, constituents, etc. that make up a material (or material of construction). Composition may refer to a flow stream of one or more chemical components.

The term "skid" as used herein may refer to one or more pieces of equipment operable together for a particular purpose. For example, a 'catwalk-power swivel skid' may refer to one or more pieces of equipment operable together to provide or facilitate presenting a tubular to a derrick or comparable rig structure. A skid may be mobile, portable, or fixed. Although 'skid' may refer to a modular arrangement of equipment, as used herein may be mentioned merely for a matter of brevity and simple reference, with no limitation meant. Thus, skid may be comparable or analogous to zone, system, subsystem, and so forth.

The term "skid mounted" as used herein may refer to one or more pieces operable together for a particular purpose that may be associated with a frame- or skid-type structure. Such a structure may be portable or fixed.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' may further include reference to a driver, such as an engine and drive shaft. Types of pumps include gas powered, hydraulic, pneumatic, and electrical.

The term "utility fluid" as used herein may refer to a fluid used in connection with the operation of a heat generating device, such as a lubricant or water. The utility fluid may be for heating, cooling, lubricating, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "power swivel" as used herein may refer to a type of equipment used on a service rig or drilling rig, mainly to facilitate rotational operations. A power swivel may be powered, such as hydraulically or electrically, for handling or rotating tubulars, and may also act as a channel for drilling fluid. It also supports the weight of the drill string of pipe safely over men's heads. as used herein may refer to any driver machine or device suitable and known to one of ordinary skill in the art to impart work, typically in the form of suspending and rotating pipe. A power swivel or a top drive is an example of such a driver. A power swivel known to one of skill as being an alternative to and different from a rotary table.

The term "track handling device" as used herein may refer to a mechanism, assembly, system, combination of equipment, and so forth for performing one or more functions associated with an industrial operation, such as drilling.

Referring now to FIGS. 2A, 2B, 2C, 2D, 2E, 2F, 2G, 2H, and 2I, a side view of a mobile unit having a stowed track handling device, a side view of the mobile unit having a mast and the track handling device in a respective first position, a side view of the mobile unit having the mast in an intermediate position, a side view of the mast in a second mast position, a side view of the track handling device in a second device position, a side view of a tubular fed to a power swivel from a side orientation, a slider movingly engaged with a torque track, a side view of the mobile unit the mast in the second mast position and an elevated power swivel engaged with a torque, and a side view of the track handling device configured with a power swivel support rack according to embodiments of the disclosure, respectively, illustrative of embodiments disclosed herein, are shown.

FIGS. 2A-2I together show a mobile unit 201 for use in an industrial operation or system 200. The operation or system 200 may be for drilling. While it need not be exactly the same, the unit 201 may be assembled, run, and operated as described herein and in other embodiments, and as otherwise understood to one of skill in the art. Similarities may not be discussed for the sake of brevity. Components of the unit 201 may be arranged by, disposed on, or otherwise coupled with a trailer or support frame 213, and as otherwise made evident.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the unit 201 for operation thereof of the system 200. For example, a pump (with engine) may be in fluid communication with one or more sources, such as a fluid tank, with the unit 201 (or its components) being in fluid communication with a discharge of the pump (such as via a manifold, piping, tubing, etc.). All components of the unit 201 requiring power or automation may be provided with wiring, tubing, piping, hydraulics, etc. in order to be operable therefore.

The unit 201 may be used with and be part of the system 200, such that the system 200 may include a mast or comparable structure configured with suitable components to rotate a drill string 204. The drill string may be rotated with a power swivel type mechanism 210 (with associated elevator, drive frame, drawworks, travel block 243, etc.).

The mobile unit 201 may be configured with the frame 213 being configured or fitted with various components attached thereon, including for transport. The frame 213 may be part of a trailer or a skid 201*a* configured to be towed or otherwise transported to a site for use. Although not shown here, the mobile unit 201 may have or otherwise be self-propelled or associated with a cab or other machine for powered transport.

The mobile unit 201 may have a mast 202, which may be portable and field-erected. The mast 202 may have a first position 242*a*, which may be stowed and ready for transport. The mast 202 may have a second position 242*a*, which may be erected and ready for operation for the system 200. As the mast 202 may be multi-piece, the mast 202 may have a first mast portion 202*a* and a second mast portion 202*b*. The first and second portions 202 a, b may be coupled together, such as telescopingly or slidingly. For height and operational concerns, there may only the two telescoping portions 202 a, b; however, it is within the scope of the disclosure that additional portions may be used. As such, there may be another mast position that includes the mast 202 raised, and the second portion 202*b* fully extended from the first portion 202*a*.

The mast 202 may be movingly coupled with the platform 213, such as at a connection point(s) 240. Just the same, the mast 202 may be assembled onsite, and is not otherwise limited to any size or configuration. Also, although shown as land-based, the associated operation of the system 200 could be offshore, such that the mobile unit 201 could be on or part of a floating vessel. While reference may be made to 'drilling', the working operation or system 200 is not meant to be limited, as there are a number of instances and operations where the unit 201 may be used.

The unit 201 may be operated or otherwise used in a manner to provide, control, facilitate, etc. handling and transport of one or more components. In embodiments, the unit 201 may provide delivery of either a tubular 203 and/or a power swivel 210 to a rig or derrick floor 241. The unit 201 may have the power swivel 210 and associated components disposed thereon, including for times of storage and/or transport. Associated or auxiliary components may include a hose reel, a hydraulic fluid tank, a pump and engine, and the like. Although not shown here, the unit 201 may have an operator station, which may allow rig personnel 207 to control the power swivel 210 and overall rig or system operation 200.

One of skill would appreciate that some or all operations associated with operating the unit 201, as well as operation of the power swivel 210 (including while on the rig 202), may be accomplished by personnel 207 via the operator station and/or manually. While not shown in detail, there may be powered systems (such as cable winch or hydraulic pistons) for raising the mast 202 from the first position 242*a* to the second position 242*b*. The mast 202 may also be powered for telescoping the portions 202 a, b (extending or retracting).

When presented to the operator 207 (or rig floor 241), the tubular 203 may be engaged (e.g., threadingly) by the power swivel 210, lifted, and then moved to a vertical position for engagement (making up) with another tubular. The tubular 203 and/or power swivel 210 may be presented or otherwise positioned at an angle. Advantageously, the tubular 203 may be presented from any side of the floor 241, such as from the first side, the second side, and/or the front.

The power swivel 210 may have a stem 234 for threadably engaging the tubular 203. The traveling block 243 of the mast 202 may be raised or lowered with the power swivel 210, as indicated by arrows A (via pulleys, cables, etc.). Although the mast 202 is shown only in part here, one of skill would appreciate that the mast 202 may extend upward by tens or hundreds of feet. One of skill would also appreciate that although only showed in partial detail here, the rig floor 241 may be part of a support structure 271, which may include legs, trusses, scaffolding, and the like. The rig floor 241 may be movable. Instead of or in addition to, the rig floor 241 may be coupled with and supported by (such as in a cantilevered fashion) the mast 202.

The operation of the system 200 may include the use of a track handling assembly or device 224. The track handling device 224 may be a combination of movable linking members configured in a manner whereby the device 224 may be in a first device position 224*a* akin to storage or retraction. This may coincide with the first position 242*a* of the mast 202. However, the position of the track handling device 224 and the mast may be mutually exclusive. As such, the mast 202 may be moved to its second position 242*b*, while the device 224 remains in the first device position 224*a*. To accommodate movement of the device 224, there may be respective pivot points 240*a* where the device 224 is movingly coupled with the frame 213.

Figure 2A:
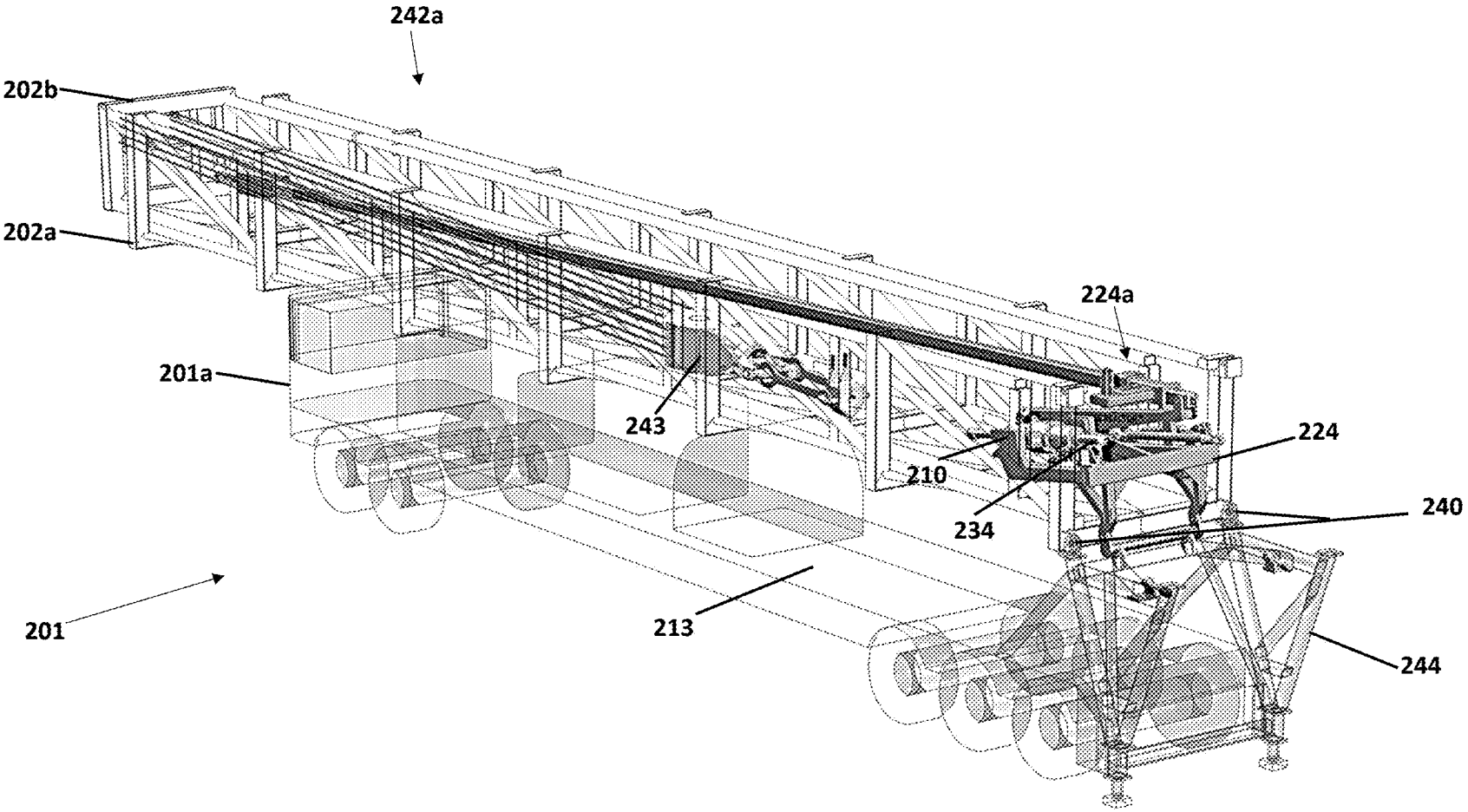
FIG. 2A shows a side view of a mobile unit having a stowed track handling device according to embodiments of the disclosure.
Figure 2D:
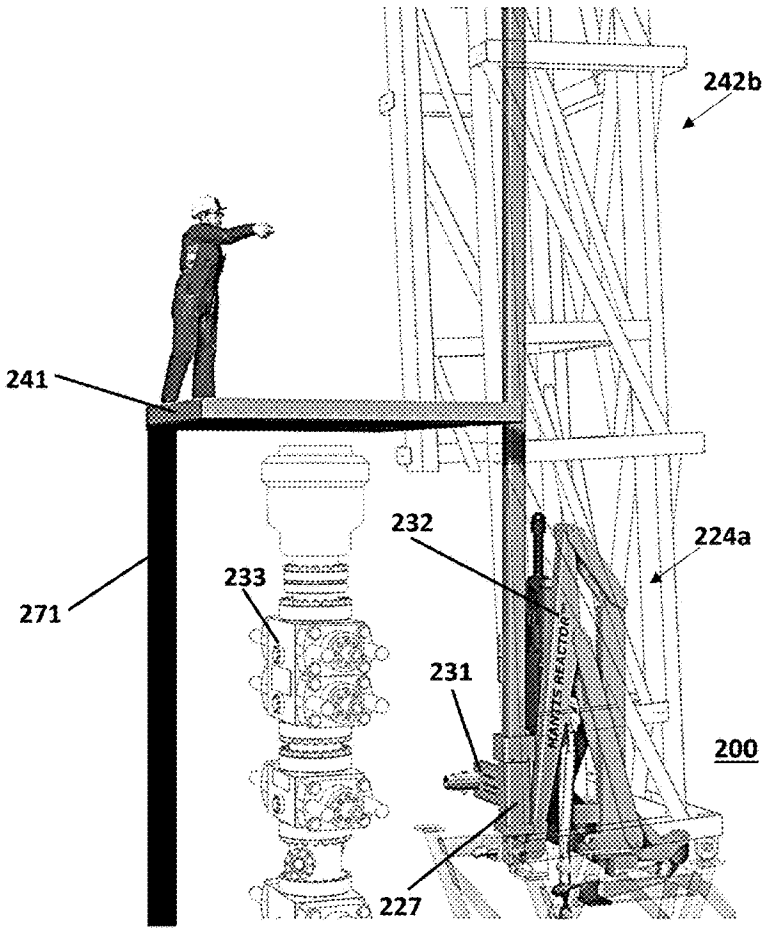
FIG. 2D shows a side view of the mast of FIG. 2A in a second mast position according to embodiments of the disclosure.
Figure 2C:
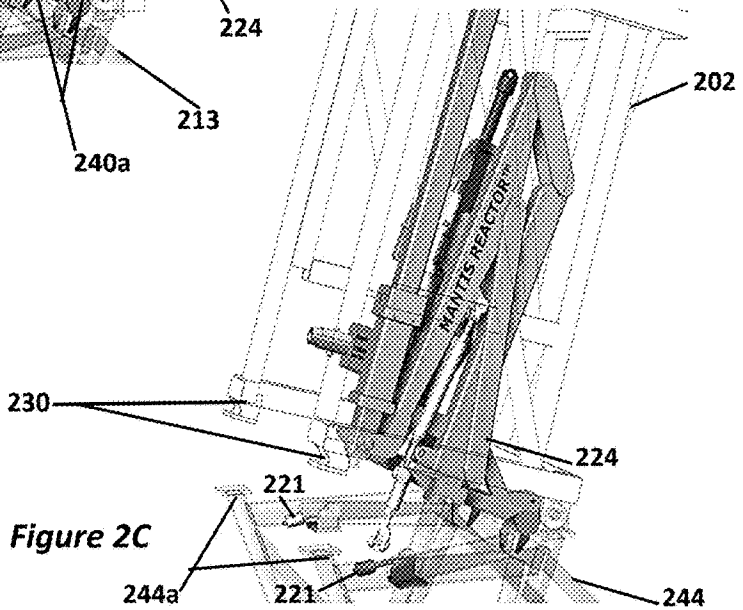
FIG. 2C shows a side view of the mobile unit of 2A having the mast in an intermediate position according to embodiments of the disclosure.
Figure 2B:
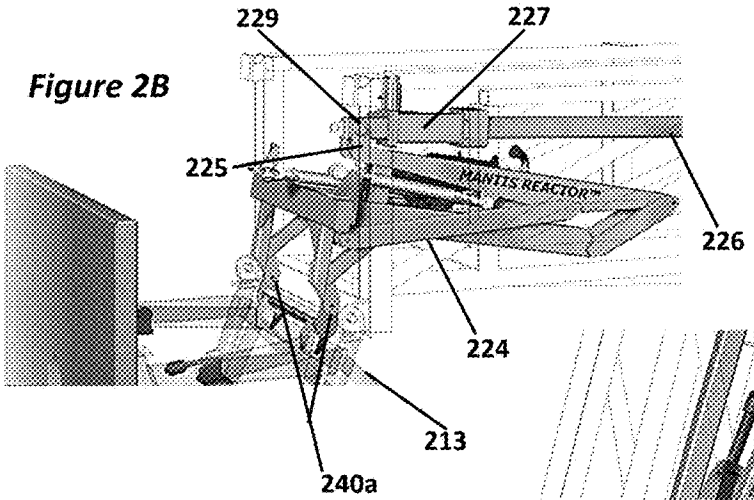
FIG. 2B shows a side view of the mobile unit of FIG. 2A having a mast and the track handling device in a respective first position according to embodiments of the disclosure.

FIG. 2B shows the track handling device 224 and the mast 202 in their respective first positions. In this position, a track 226 lies prone with a slider 227 movingly engaged therewith. The track 226 may be coupled with a boot 225 of the device 224. The boot 225 and the track 226 may be coupled together at coupling point 229, such as via nut and bolt or the like.

FIG. 2C shows an intermediate position of the mast 202, where the mast 202 may be moving to or from the first mast position 242*a*. The intermediate position may be contemplated as a range of positions other than the first mast position 242*a*, and whereby mast legs 230 are not engaged with respective mast support legs 244*a* (of the mast support frame 244). During this transition, the track handling device 224 may remain in the first device position 224*a*.

Figure 2G:
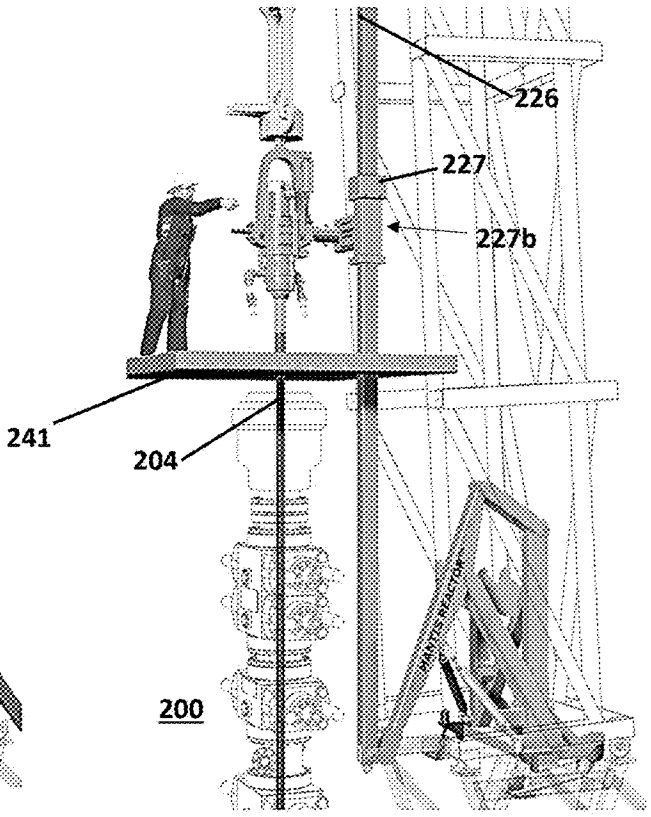
FIG. 2G shows a slider movingly engaged with a torque track according to embodiments of the disclosure.
Figure 2F:
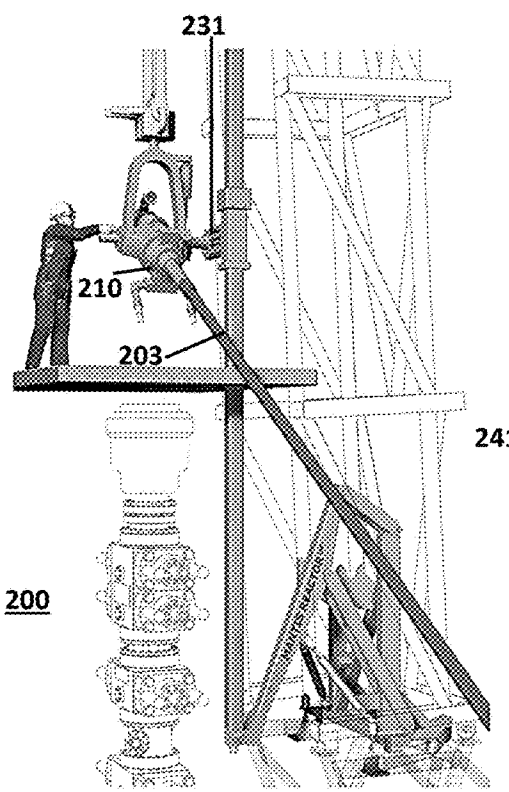
FIG. 2F shows a side view of a tubular fed to a power swivel from a side orientation according to embodiments of the disclosure.
Figure 2E:
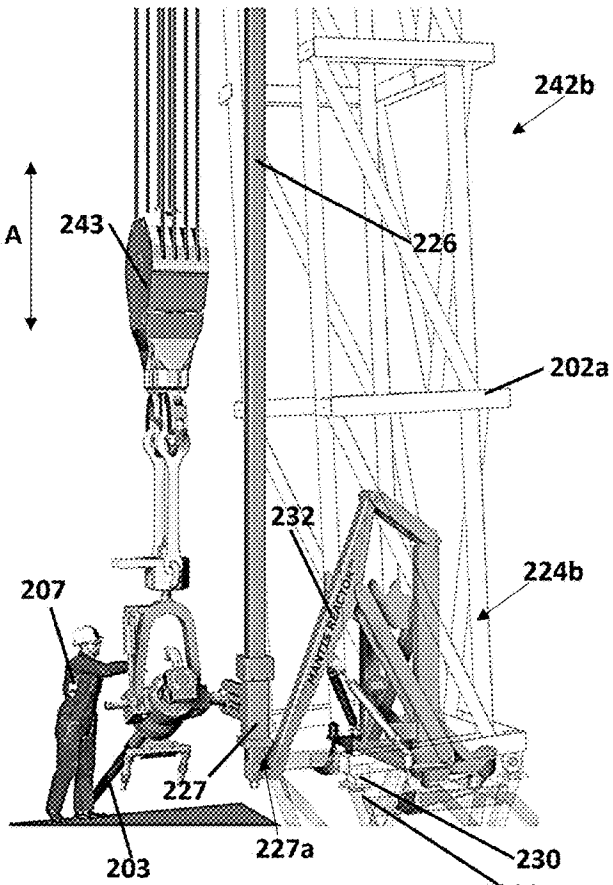
FIG. 2E shows a side view of the track handling device FIG. 2A in a second device position according to embodiments of the disclosure.

FIGS. 2D and 2E together show the mast 202 now moved to its second position 242*b*, and with the track handling device 224 moving from its first position (224*a*, FIG. 2D) to its second position (224*b*, FIG. 2E). The second position 224*b* may coincide with the track handling device 224 being moved over a wellhead (or BOP, etc.) 233. As shown, the device 224 may have a main arm 232 extended outward (compare 2D with 2E). The main arm 232 may have an end configured with the boot 225, such that as the main arm 232 is extended out, by being coupled therewith, the track 226 may also be extended outward.

To facilitate movement of the device 224, the operator 207 may couple the device 224 with the power swivel 210. For example, the slider 227 may be configured or coupled with a power swivel coupler 231, which may then be coupled with the power swivel 210. The operator 207 may then grab and move the power swivel, which resultantly moves the device 224.

FIGS. 2E and 2F illustrate the tubular 203 may be fed and coupled with the power swivel 210 from different directions. There are a number of reasons why it may be beneficial to accommodate feeding and connecting tubulars from different sides of the rig floor 241, and advantageously the track handling device 224 may accommodate any such necessity. For example, the swivel coupler 231 may be interchangeable with other coupler configurations and orientations. In addition, or the alternative, the slider 227 may be rotated (e.g., 90 degrees, 180 degrees, etc.) on the track 226.

FIGS. 2E and 2G illustrate that the slider 227 may be moved along the track 226 from a first or bottom position (227*a*, FIG. 2E) to another position (227*b*, FIG. 2G). As the slider 227 may be freely movable along the track 226, the power swivel 210 may be raised and lowered accordingly (see Arrow A). At the suitable height, the power swivel 210 may now be operational to rotate the drillstring 204.

Figure 2I:
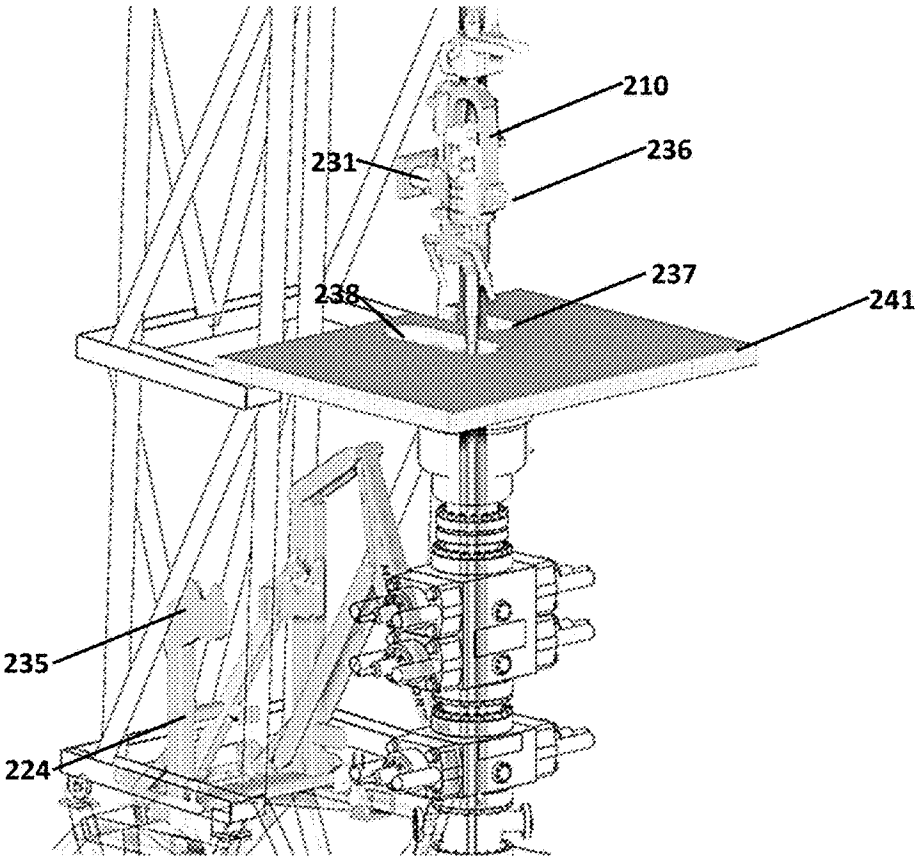
FIG. 2I shows a side view of the track handling device configured with a power swivel support rack according to embodiments of the disclosure.
Figure 2H:
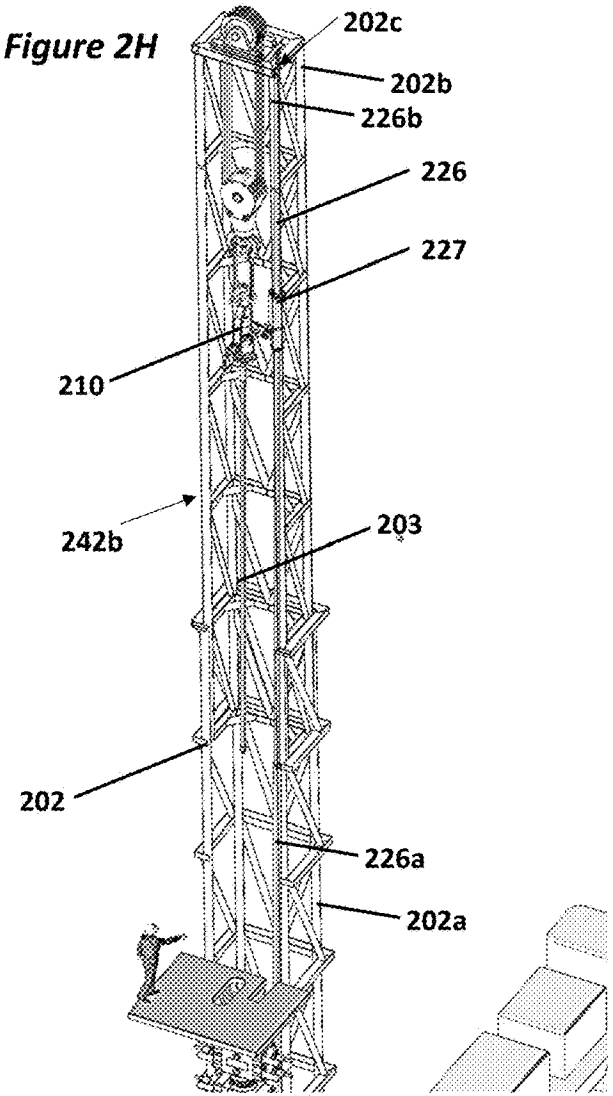
FIG. 2H shows a side view of the mobile unit of 2A having the mast in the second mast position and an elevated power swivel engaged with a torque track according to embodiments of the disclosure.

FIG. 2H illustrates the mast 202 moved to its second mast position 242*b*. As one of skill would appreciate, in this position the second mast portion 202*b* has been extended out and upward of the first mast portion 202*a*, such that the mast 202 may be at its fully extended height H. The slider 227 remains freely movable along the track 226, such that the power swivel 210 may be moved to any height in order to accommodate make up and break out of the tubular(s) 203 or other desired operation.

One of skill would appreciate that as there may be the first mast portion 202*a* and the second mast portion 202*b*, the track 226 may analogously have a first track portion 226*a* and a second track portion 226*b*. The first track portion 226*a* and the second track portion 226*b* may be movingly engaged with each other, such as slidingly, telescopingly, etc. While the first track portion 226*a* may be coupled with the boot coupler (not viewable here), the second track portion 226*b* may be coupled with the mast 202 at top track coupling point 202*c*. Thus, as the mast portions 202 a, b extend and retract together, so may the track portions 226 a, b.

FIG. 2I illustrates the track handling device 224 may be configured with a power swivel support rack 235. The power swivel 210 may have one or more torque arms 235 extending therefrom suitable for engagement/disengagement with the support rack 235. The power swivel coupler 231 may be configured for engagement with any of the torque arms 236. The coupling between the power swivel 210 via the torque arm 235 to the coupler 231, and via the coupler 231 to the slider 227, and via the slider 227 to the track 226 may facilitate transfer of torque or other load from operation of the power swivel 210 to the mast 202.

FIG. 2I further illustrates how the rig floor 241 may be configured with either or both of a tubular gap or clearance 238 (for tubular 203 to fit therethrough) and a track gap or clearance 237 (for track 226 to fit therethrough).

Figure 3B:
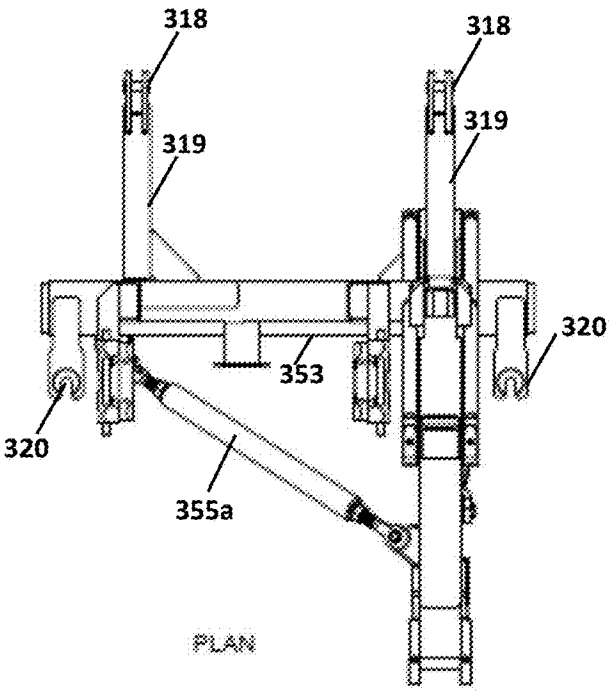
FIG. 3B shows a downward plan view of the track handling device of FIG. 3A according to embodiments of the disclosure.
Figure 3A:
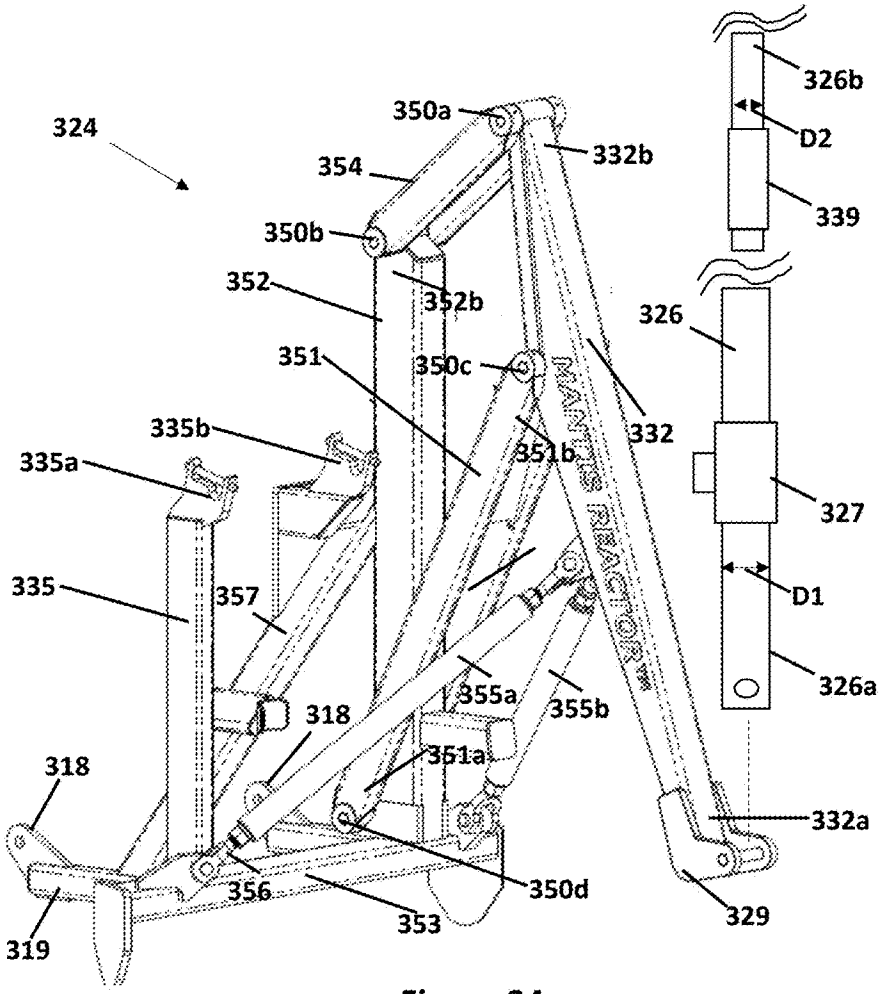
FIG. 3A shows a front side isometric view a track handling device according to embodiments of the disclosure.
Figure 3C:
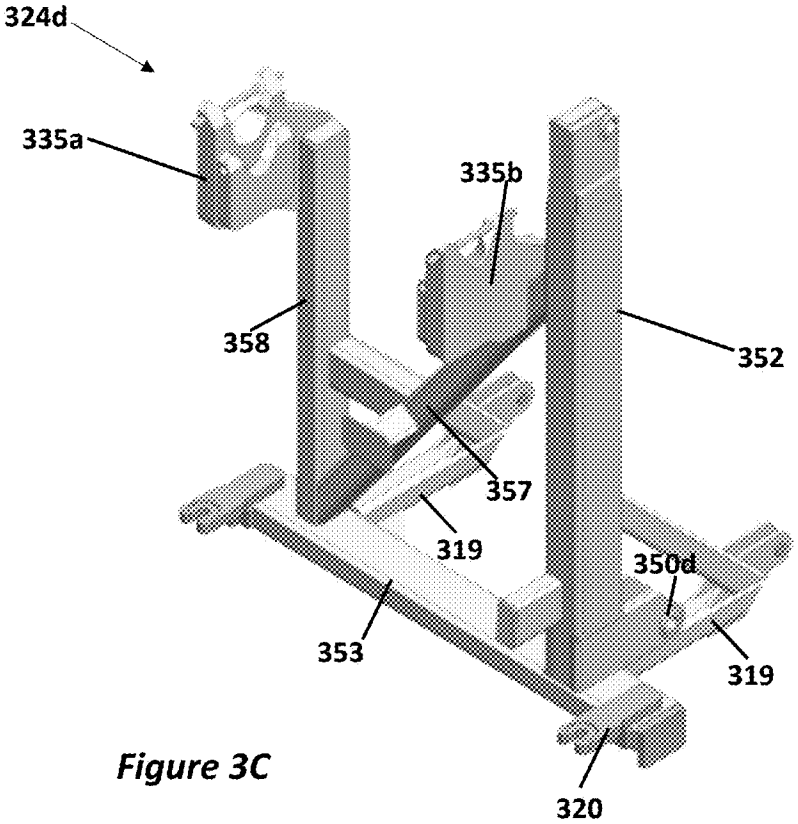
FIG. 3C shows a front side isometric view of a rigid frame of the track handling device of FIG. 3A according to embodiments of the disclosure.

Referring now to FIGS. 3A, 3B, and 3C, a front side isometric view of a track handling device, a downward plan view of the track handling device, and a front side isometric view of a rigid frame of the track handling device, respectively, illustrative of embodiments disclosed herein, are shown.

FIGS. 3A-3C together show a track handling device 324 that may be used with a rig, derrick, or other comparable equipment. While referred to as a 'drilling operation' from time to time, embodiments herein are not limited and other applications are possible. Without limitation, the track handling device 324 may be like that of other device(s) (e.g., 224) described herein, including in some respects similar/identical or in other respects different.

The track handling device 324 may be an assembly of multiple component(s) and subcomponent(s) features, any of which may be connected with (such as fixedly [e.g., welded or the like] or movingly) or integral to each other. To accommodate rigor and stress associated with operation of the device 324, many or all (sub) components may be made of a durable metal, such as carbon steel. That said, some parts of the device 324 may be rubber, plastic, or other suitable material. The device 324 may be configured to withstand loads (including significant loads) associated with operation of a power swivel (210) or other rotational driver.

The track handling device 324 may be a combination of a static or rigid portion 324*d* coupled together with one or more movable members of a movable portion. For example, the rigid portion 324*d* may include a base frame or spreader 353 having one or more posts or arms 352, 358 extending therefrom. As shown here, there may be main post 352 and a support rack post 358 having a general vertical orientation as compared to the horizontal nature of the spreader 353.

Either or both of the main post 352 and the support rack post 358 may be configured with a power swivel support rack feature 335*b* and 335*a*, respectively. These seat-style features 335*a* and 335*b* may be useable separate or together to provide a support rack 335 for a power swivel (210). This may aid simple and convenient capability or storage and transport of the power swivel (see FIG. 2A).

The spreader 353 may have one or legs 319 extending therefrom. The legs 319 may have a respective hinge mount 318, suitable for coupling the device 324 with a support frame or structure (213/244). The hinge mounts 318 may provide the capability for the device 324 to be movingly (such as hingedly or pivotably) coupled with the support frame or structure.

The spreader 353 may also have one or more latch receptacles 320 extending therefrom. The latch receptacle 320 may be configured to receive a respective latch (e.g., 221, FIG. 2C), which may be useful to help lock and maintain the track handling device 324 in an upright position. In aspects, the track handling device 324 may be moved from a resting or prone position to the upright position, and vice versa.

The rigid portion 324*d* may also have one or more other support members or beams, such as a cross or diagonal member 357. The cross member 357 may extend between the main post 352 and the support rack post 358, including diagonally, as shown here. The rigid portion 324*d* may be coupled with a movable portion that includes one or more dynamic or moving members. For example, the device 324 may have a driver arm 351 coupled with rigid portion 324*d*. The driver arm 351 may have a first or bottom driver arm portion 351*a* (movably) coupled with the rigid portion 324*d* (or spreader 353) at pivot or coupler point 350*d*. The driver arm 351 may have a second or top driver arm portion 351*b* (movably) coupled with a main support arm 332 at pivot or coupler point 350*c*.

The driver arm 351 may have a hollowed arm region 359 configured to accommodate upward and downward motion of the driver arm 351 with respect to the main post 352. In this manner, the driver arm 351 and the main support arm 332 may be operable together for the device 324 to move from its first or retracted position (224*a*, FIG. 2D) to its second or extended position (224*b*, FIG. 2E), and vice versa.

In addition, there may be a follower arm 354 that may be movable. The follower arm 354 may be (movably) coupled with an upper end 332*b* of the main support arm 332, such as at pivot or coupler point 350*a*. The follower arm 354 may be (movably) coupled with an upper post portion 352*b* of the main post 352, such as at pivot or coupler point 350*b*. The arms 351, 354, and 332 may then work together to provide the dynamic or movable feature of the track handling device 324.

The movable portion of the track handling device 324 may accommodate the support and use of a torque track (or just track) 326. FIG. 3A shows in partial detail the track handling device 324 may include the track 326. The track 326 is an elongated member in the tens or hundreds of feet in its length. The track 326 may be configured to handle and distribute loads/torque associated with a power swivel. The track 326 may be coupled with a boot coupler 329 extending from a first or lower arm end 332*a* of the main support arm 332.

In accordance with embodiments herein, the track handling device 324 may be used with a telescoping mast (202). In a similar sense, it may be the case that the track handling device 324 may be used with a telescoping track 326, such as shown in part in FIG. 3A.

For example, the track 326 may have a first or lower track portion 326*a*. The first track portion 326*a* may have a first track dimension (e.g., width, diameter, etc.) D1. There may be a second track portion 326*b*, which may have its respective track dimension D2. The first track portion 326*a* and the second track portion 326*b* may be movably coupled together, such as telescopingly. As such, the first track dimension D1 may be larger than the respective (second) track dimension D2. The first track portion 326*a* may be configured in a manner for the second track portion 326*b* to extend therefrom and retract thereinto.

There may be a slider 327 movably engaged with the track 326. Although not shown in detail here, the slider 327 may be configured in a manner for the slider 327 to couple with a power swivel (210). In operation of the power swivel, the swivel may be raised or lowered, and as such the slider 327 may follow along via freedom of movement on the track 326. The slider 327 may be configured with pads or rollers that reduces or mitigates friction between the track 326 and the slider 326.

Although the slider 327 may be configured for movable engagement with a given track dimension (e.g., D1), the slider 327 may not be able to readily move onto and accommodate engagement with a different track dimension, such as D2. As such, there may be an adapter or bushing 339 movably engaged with the track 326, and more particularly, the second track portion 326*b*. The bushing 339 may be configured with pads or rollers that reduces or mitigates friction between the track 326*b* and the slider bushing 339.

The slider 327 and the bushing 339 may be configured for engagement together in the event the slider 327 is moved toward the second track portion 326*b*. As an example, and although not shown here, the slider 327 may have a mating feature corresponding to a respective mating feature of the bushing. Upon engagement, the mating features operate together to keep the slider 327 engaged with the bushing 339 as the power swivel is moved respectively with the second track portion 326*b*.

The respective mating feature of the bushing 339 may be configured to release from the mating feature of the slider 337 in the event the power swivel is moved back toward and respectively with the first track portion 326*a*. For example, the first track portion 326*a* may be configured with a profile or feature that prompts disengagement of the mated slider/bushing upon contact therewith.

The moving portion of the device 324 may have additional support from one or more turnbuckles 355*a*, 355*b*. The turnbuckles 355*a*, 355*b* may be coupled between the main support arm 332 and the spreader 353. As such, each of the support arm 332 and the spreader 353 may be configured with features or fittings for the respective turnbuckle 355*a*, 355*b* to couple therewith.

Figure 4:
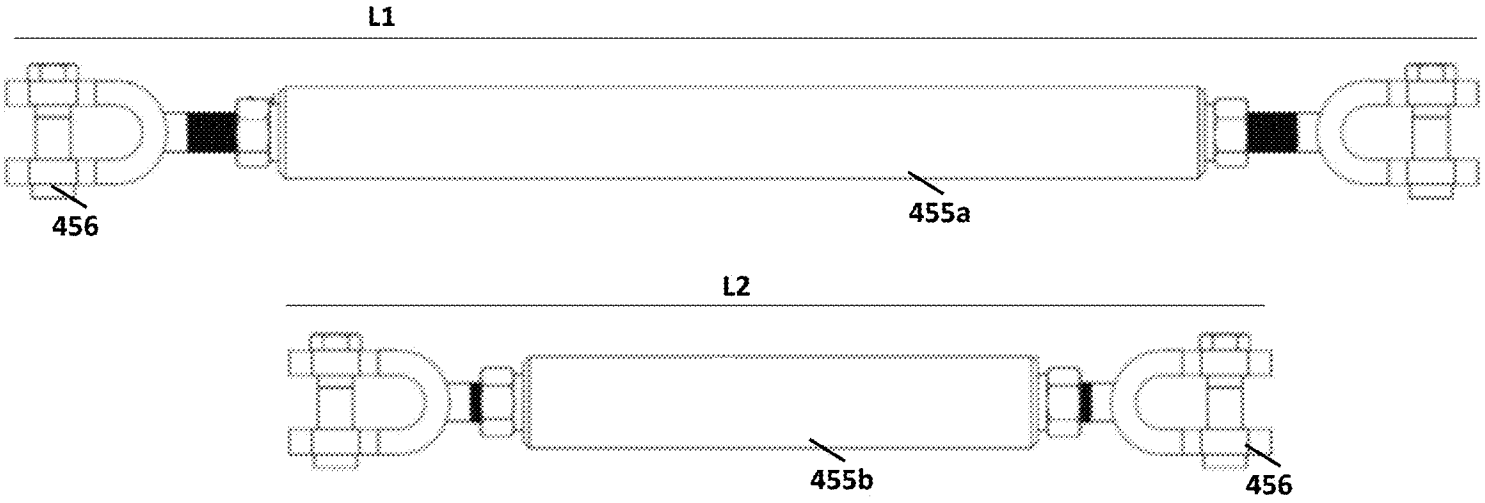
FIG. 4 shows a longitudinal side view of a first turnbuckle and a second turnbuckle according to embodiments of the disclosure.

Referring briefly to FIG. 4, a longitudinal side view of a first turnbuckle and a second turnbuckle, illustrative of embodiments disclosed herein, is shown. FIG. 4 shows a first turnbuckle 455*a* and a second turnbuckle 455*b* that may be used with a track handling device of the present disclosure. The first turnbuckle 455*a* may be configured with a first turnbuckle length L1, and the second turnbuckle 455*b* may be configured with a second turnbuckle length L2. Although not limited, the first turnbuckle length L1 may be longer than the second turnbuckle length L2.

Referring again to FIGS. 3A-3C, the use of turnbuckles 355*a* and 355*b* with respective offset lengths may accommodate an offsetting of the main post 352 from a centerline of the spreader 353. As the post 352 is offset so may be the moving arms 351, 354, 332. This configuration may provide clearance for the power swivel to move back and forth from the power swivel support rack 335.

Referring now to FIGS. 5A, 5B, 5C, and 5D, a side view of a power swivel in a first swivel orientation coupled with a slider, a power swivel in a second swivel orientation coupled with a slider, a partial side cross-sectional view of a power swivel torque arm engaged with a slider lug, and an isometric view of an alternate slider lug, respectively, illustrative of embodiments disclosed herein, are shown.

FIGS. 5A-5D together show a track handling device of the present disclosure may include or be associated with a power swivel 310 coupled (via a power swivel coupler 331) with a track slider 327. The coupling between the power swivel 310 and the track slider 327 may further include the power swivel 310 having one or more torque arms 336 that extend therefrom. A coupler lug 361 may be inserted through the coupler 331 and into engagement with the respective torque arm 336. As shown here, the coupler lug 361 may have an opening or bore 361*a* for the torque arm 336 to fit therein. There may be a coupler pad or insert 363, such as between the coupler 331 and the lug 361, which may help accommodate discrepancies or differences between different pieces of equipment.

Figure 5B:
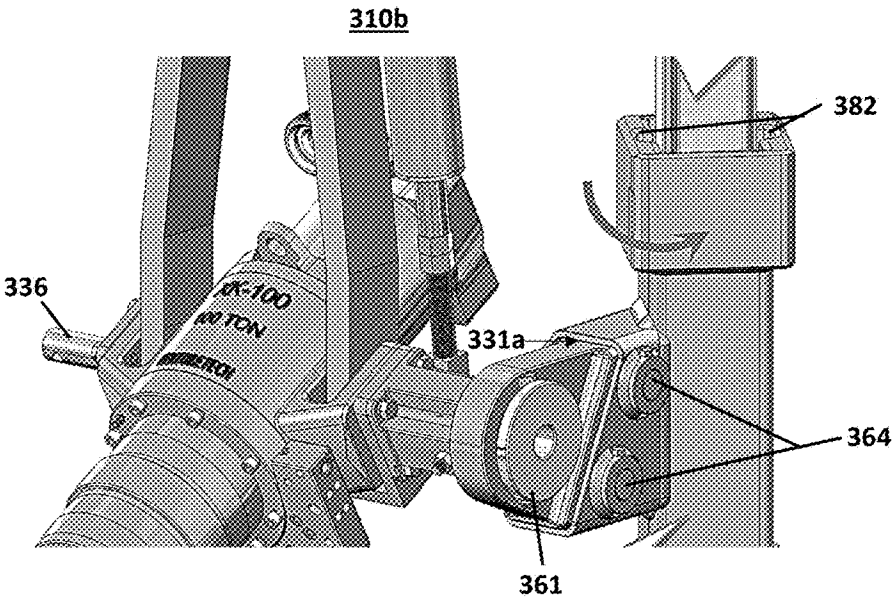
FIG. 5B shows a side view of a power swivel in a second swivel orientation coupled with a slider longitudinal side view of a first turnbuckle and a second turnbuckle according to embodiments of the disclosure.
Figure 5A:
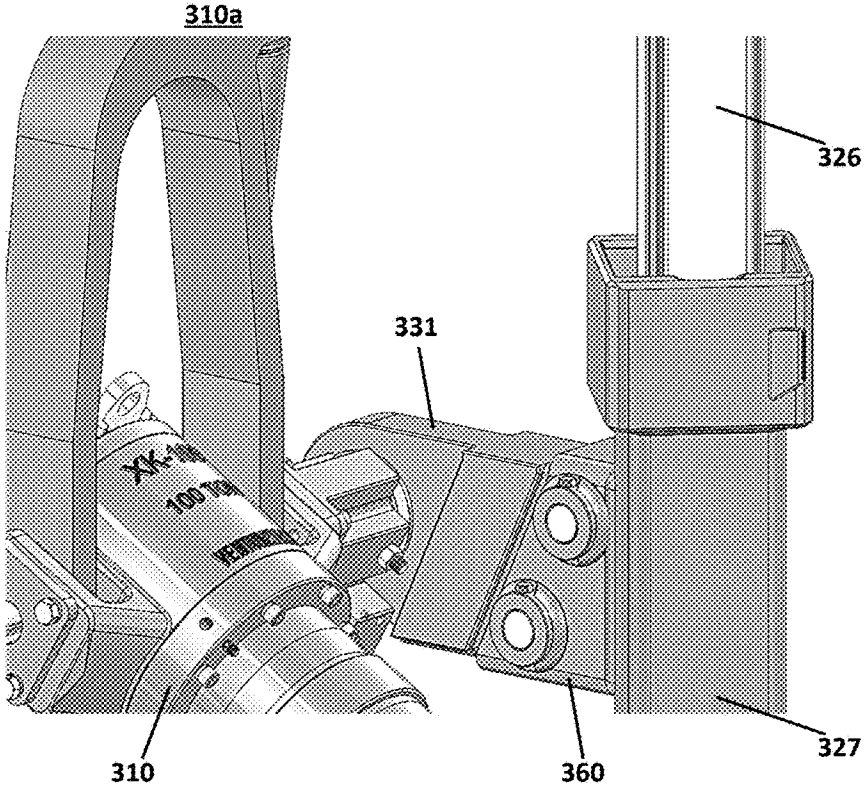
FIG. 5A shows a side view of a power swivel in a first swivel orientation coupled with a slider longitudinal side view of a first turnbuckle and a second turnbuckle according to embodiments of the disclosure.
Figure 5D:
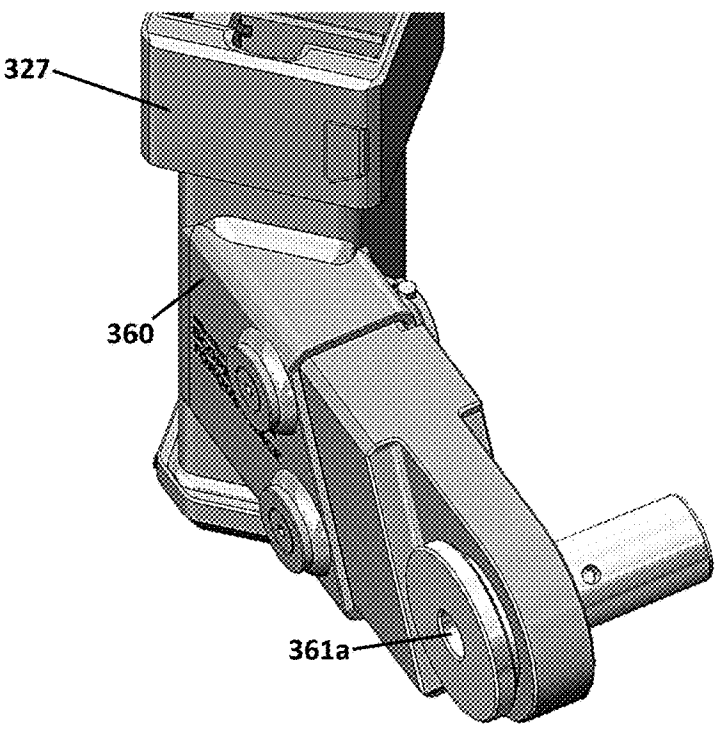
FIG. 5D shows an isometric view of an alternate slider lug according to embodiments of the disclosure.
Figure 5C:
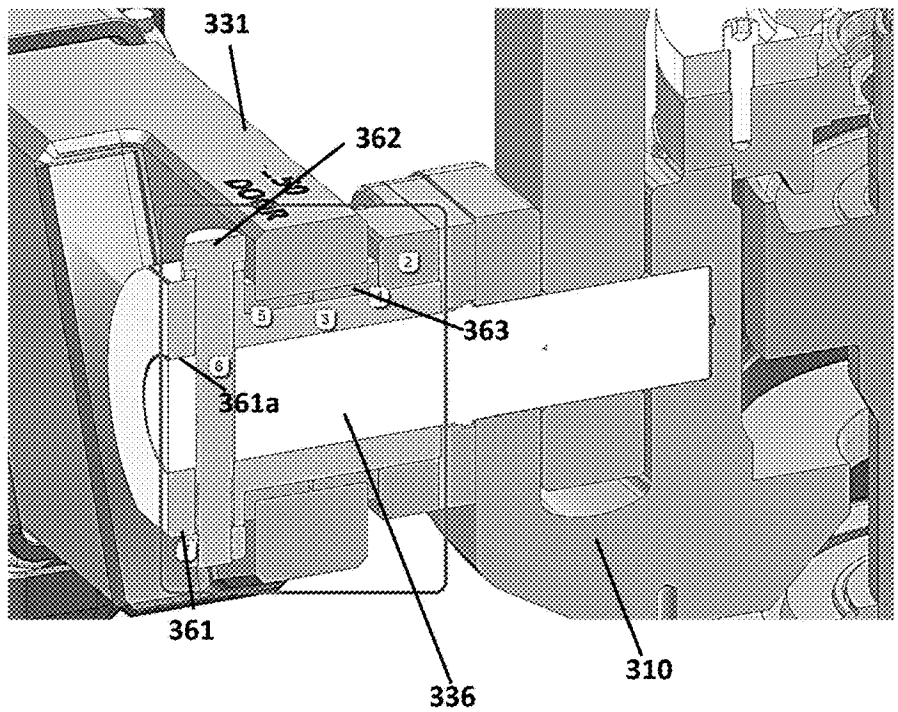
FIG. 5C shows a partial side cross-sectional view of a power swivel torque arm engaged with a slider lug according to embodiments of the disclosure.

A lug pin 362 or other comparable securing device may be inserted through each of the lug 361 and the torque arm 336, such that the lug 361 and arm 336 are held together. There may be a housing or extension 360 for which the coupler 331 may have a coupler end 331*a* inserted therein. One or more coupler pins or bolts 364 may be inserted through the extension and coupler end 331*a* for securely holding the coupler 331 therewith. FIGS. 5A and 5B show how the power swivel 310 may have a first swivel orientation 310*a*, but in the event another or second orientation 310*b* may better suit operation, the coupler 331, lug 361, slider 327, etc. may be reconfigured to accommodate changes in orientation (which then corresponds to different orientations for which a tubular may be fed to the power swivel 310).

Figure 6B:
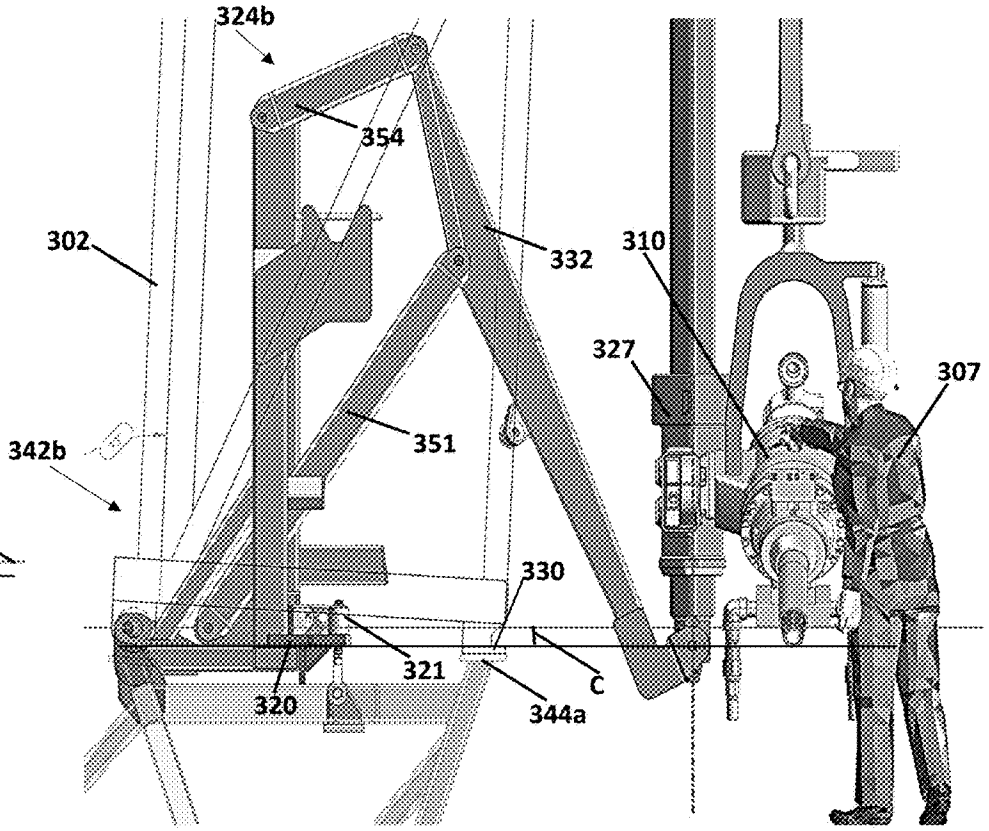
FIG. 6B shows a side view of a track handling device in a second position according to embodiments of the disclosure.
Figure 6A:
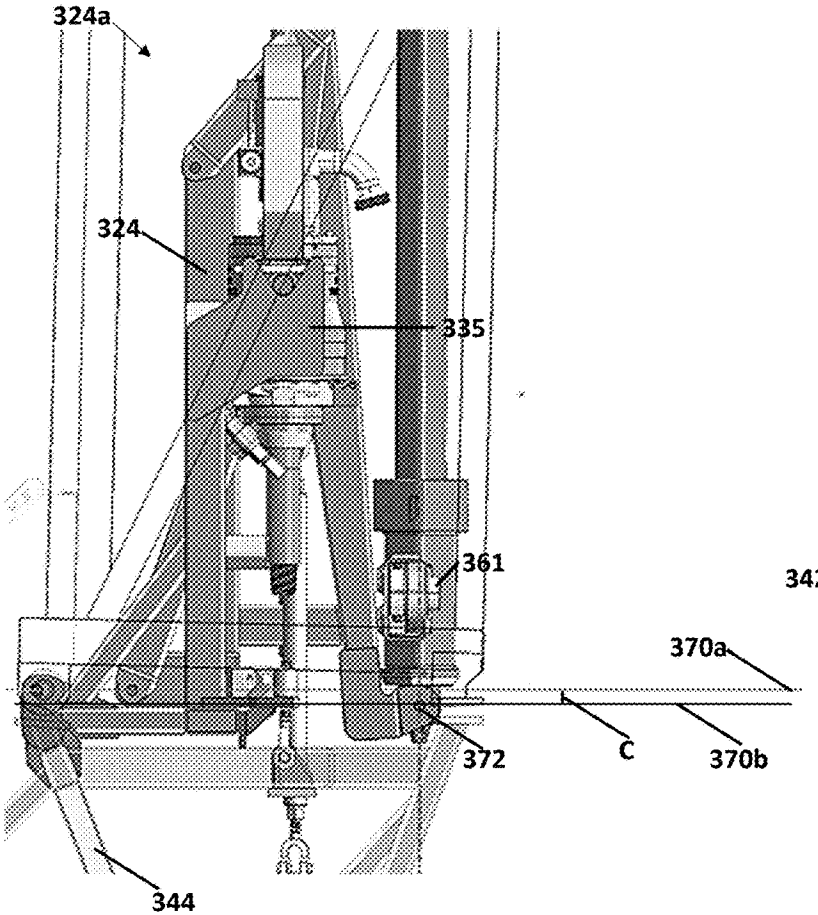
FIG. 6A shows a side view of a track handling device in a first position according to embodiments of the disclosure.

Referring now to FIGS. 6A and 6B, a side view of a track handling device in a first position and a side view of the track handling device in a second position, respectively, illustrative of embodiments disclosed herein, are shown.

FIGS. 6A and 6B together show a track handling device 324 of the present disclosure. The track handling device 324 may be coupled with a mast support frame 344. The first position 324*a* of the track handling device 324 may include a power swivel 310 stowed or engaged on a support rack 335. The track handling device 324 may be maintained in the first position 324*a* until a mast 302 is moved to its final, secured position 342*b* shown in FIG. 6B. In the final position 342*b*, mast legs 330 may be engaged with respective support frame legs 344*a*.

The track handling device 324 may be movingly engaged with the mast 344; as the device 324 is moved upright, latches 321 may be engaged with latch points 320, which may provide additional stability to the device 324. When desired to return the device 324 to a prone position, the latches 321 may be disconnected from the latch points 320.

Once the mast 302 may be made secure, an operator 307 may couple the power swivel 310 with a slider 327 via coupler lug 361. The power swivel 310 may then freely be moved from the support rack 335. As the power swivel 310 may be coupled with the track handling device 324, this may result in the track handling device 324 being moved to the second position 324*b*.

Of interest, the track handling device 324 may have a horizontal driver pin axis or reference line 370*a*. Analogously, boot pin 372 may have a horizontal boot pin axis or reference line 370*b*. As the arms 351, 354, 332 move with some amount of rotation or pivot, the track device 324 remains in a (near) straight line mechanism, as illustrated by a clearance C remaining constant (within 0.5 inches) between the first position 324*a* and the second position 324*b*.

Referring now to FIGS. 7A, 7B, 7C, 7D, 7E, and 7F, a side profile view of part of a torque track slider and bushing, a side profile view of a power swivel engaged with the slider, a side profile view of the slider engaged with the bushing, a side profile view of a bushing housing removed from the bushing, a side profile view of the slider and bushing moving together over a track with reduced dimension, and a side profile view of a bushing body, respectively, illustrative of embodiments disclosed herein, are shown.

FIGS. 7A-7F together show the operation or system (200) may include a track 326 having one more track portions with varied dimension (e.g., width). As shown, there may be a first or lower track portion 326*a* engaged with a second track portion 326*b*. The engagement between the portions 326 a, b may be, for example, telescopingly. Thus, the second track portion 326*b* may extend out from and retract into the first track portion 326*a*.

In the extended position, akin to an operational configuration of the system, a power swivel 310 may be able to be raised and lowered along either of the track portions 326*a* and 326*b*. The power swivel 310 may be coupled with a movable slider 327 that is engaged with the track portion 326*a*, and thus the slider 327 may be configured to accommodate the dimension or shape of the first track portion 326*a*.

As the slider 327 approaches a transition 380 of where the second track portion 326*b* is positioned, a top slider end 327*a* may come within proximity to a bushing or adapter 339. Just as the slider 327 may be movable along the first track portion 326*a*, the bushing 339 may be configured to accommodate the dimension or shape of the second track portion 326*b*.

Figure 7C:
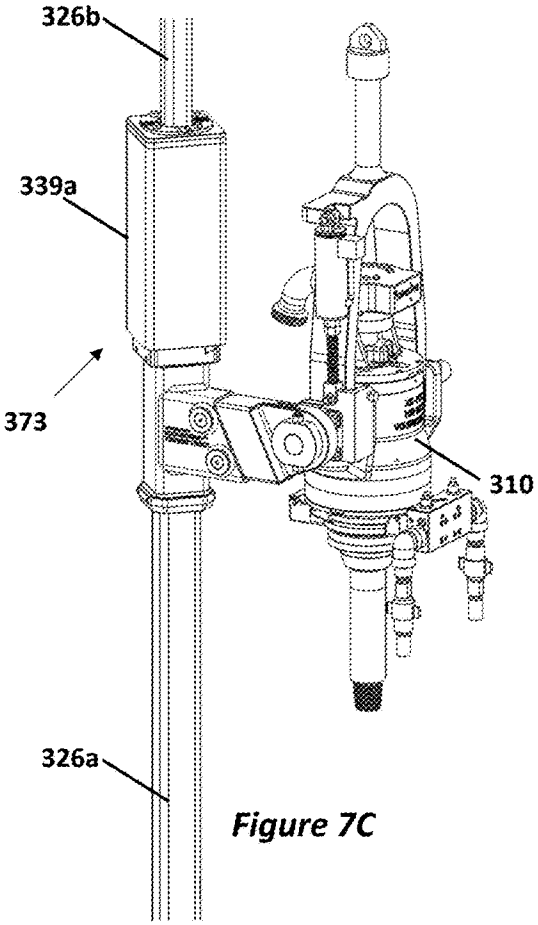
FIG. 7C shows a side profile view of the slider engaged with the bushing according to embodiments of the disclosure.
Figure 7B:
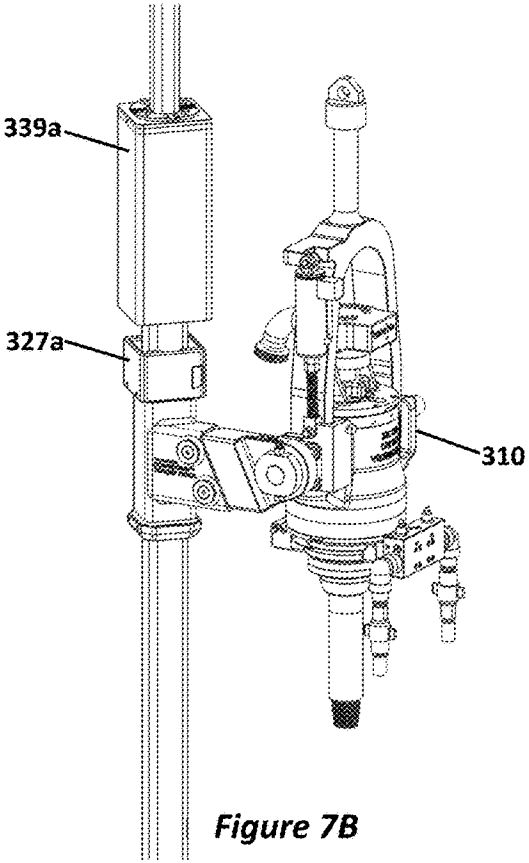
FIG. 7B shows a side profile view of a power swivel engaged with the slider according to embodiments of the disclosure.
Figure 7A:
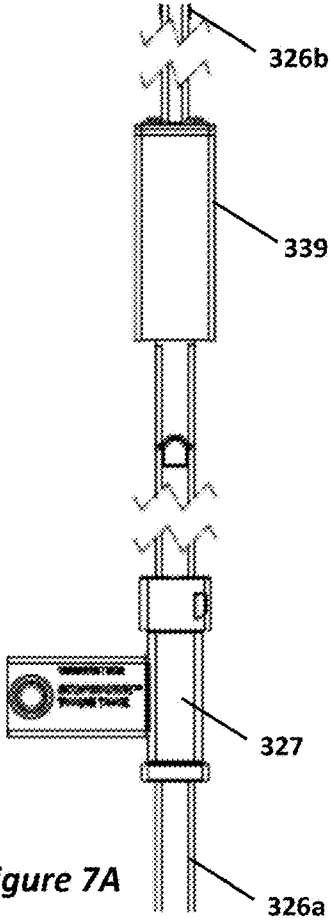
FIG. 7A shows a side profile view of part of a torque track slider and bushing according to embodiments of the disclosure.
Figure 7F:
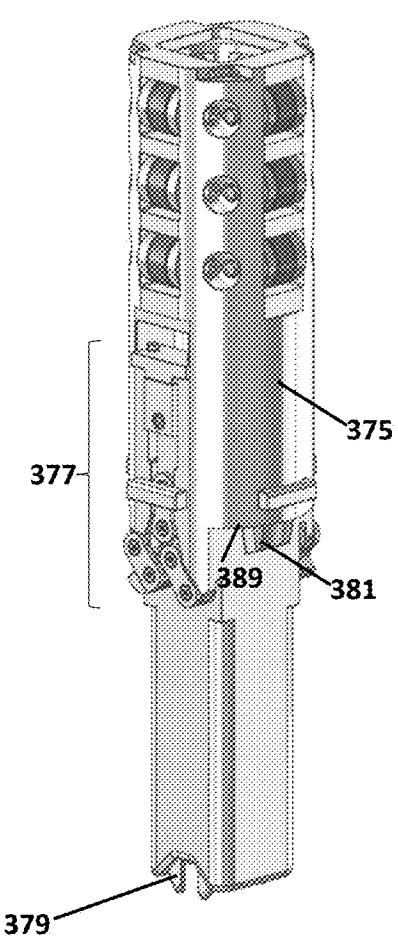
FIG. 7F shows a side profile view of a bushing body according to embodiments of the disclosure.
Figure 7E:
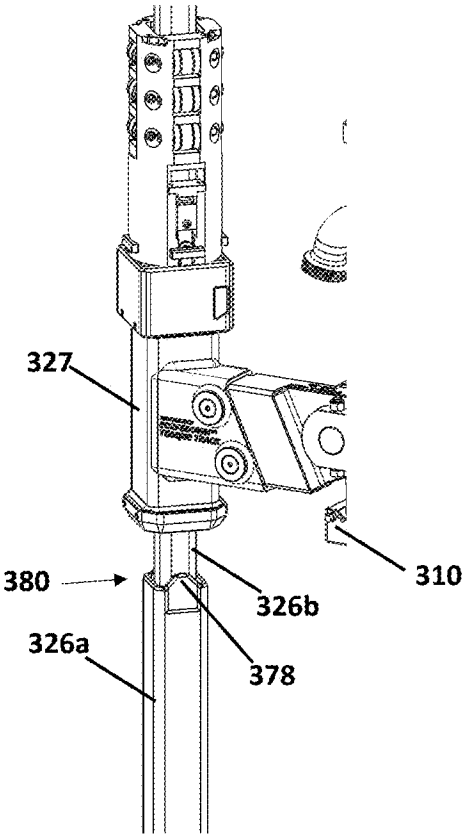
FIG. 7E shows a side profile view of the slider and bushing moving together over a track with reduced dimension according to embodiments of the disclosure.
Figure 7D:
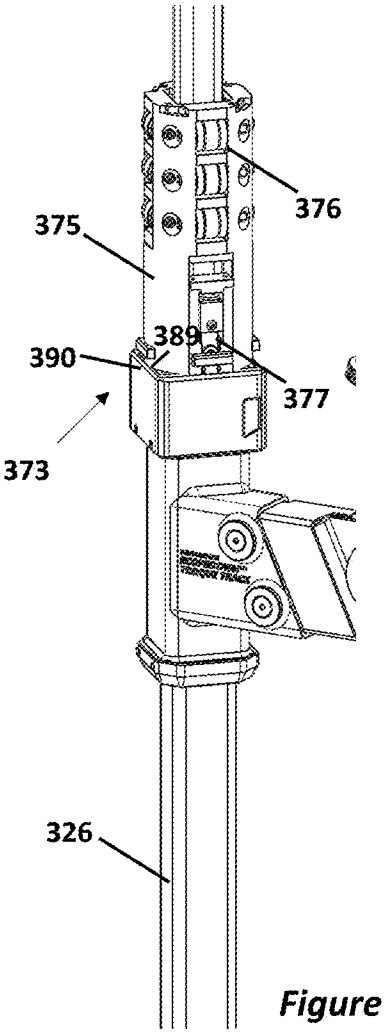
FIG. 7D shows a side profile view of a bushing housing removed from the bushing according to embodiments of the disclosure.

The bushing 339 may be configured for rapid engagement and release with the slider 327 so that during operation there is no noticeable lag when the power swivel 310 needs to traverse the transition 380 upwardly or downwardly. FIGS. 7C and 7D in particular show the slider 327 and the bushing 339 in a latched engaged position 373 (FIG. 7D has the bushing housing 339*a* removed in order to provide a clearer view of engagement).

Once engaged, the slider 327 and the bushing 339 may move collectively together (with power swivel 310) along the second track portion 326*b*. To aid movement between the bushing 339 and the second track portion 326*b*, a main bushing body 375 may be configured with one or more rollers or pads 376.

To maintain engagement between the bushing 339 and the slider 327, there may be a latch mechanism 377. The latch mechanism 377 may be configured to activate upon engagement by the slider 327 with the bushing, and resultantly latch and hold the bushing 339 and the slider 327 together. In addition, there may be one or more bushing protrusions 381 configured to mate with a respective slider receptacle (see 382, FIG. 5B).

The latch mechanism 377 may include an elongated latch member or piston 379 configured to move and cause release or unlock of the latch mechanism 377, thus resulting in latch disengagement between the slider 327 and the bushing 339. The latch piston 379 may be moved when the engaged slider/bushing come back into proximity with the first track portion 326*a*. At this point, a track profile or shoulder 378 comes into contact with the piston 379, and resultantly causes movement thereof. Upon release, the slider 327 is now free to move again on the first track portion 326*a*.

Referring now to FIGS. 8A, 8B, 8C, 8D, and 8E, a side profile view of a slider proximate to a bushing, a side profile view of the slider and bushing in a latched engagement, a partial side view of the latched engagement of the slider and bushing, a partial side view of an unlatched engagement of the slider and bushing, and an isometric component view of a latch mechanism, respectively, illustrative of embodiments disclosed herein, are shown.

FIGS. 8A-8E together show in greater detail the events that occur when a slider 327 comes into proximity with the bushing 339. As mentioned, when a power swivel 310 is coupled with the slider 327 (via coupler 331), the power swivel 310 and slider 327 may be freely movable along a track (326) having a first track portion 326*a* and a second track portion 326*b*.

Figures 8A, 8B, 8C, 8D:
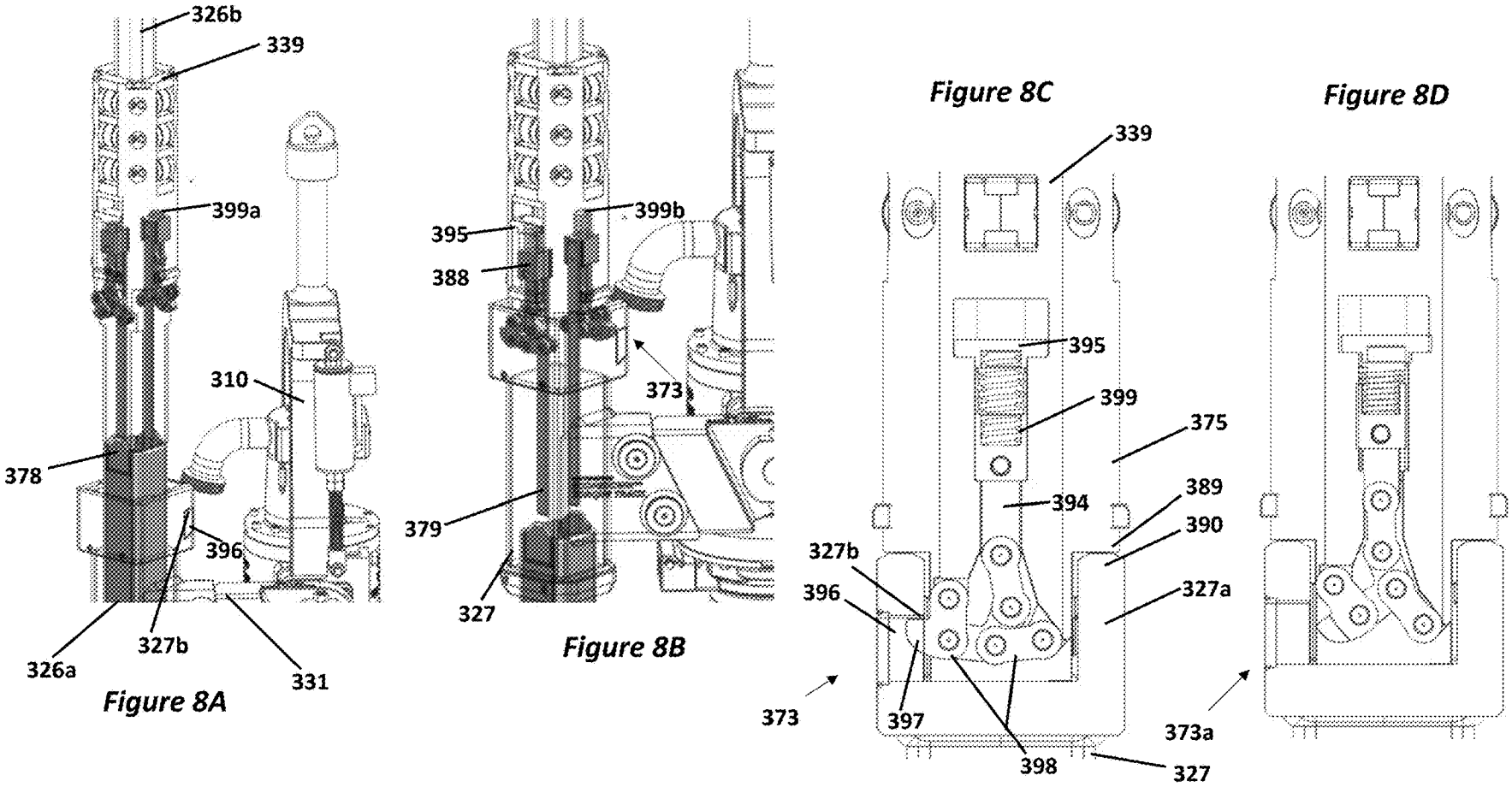
FIG. 8A shows a side profile view of a slider proximate to a bushing according to embodiments of the disclosure.
FIG. 8B shows a side profile view of the slider and bushing of FIG. 8A in a latched engagement according to embodiments of the disclosure.
FIG. 8C shows a partial side view of the latched engagement of the slider and bushing of FIG. 8A according to embodiments of the disclosure.
FIG. 8D shows a partial side view of an unlatched engagement of the slider and bushing of FIG. 8A according to embodiments of the disclosure.
Figure 8E:
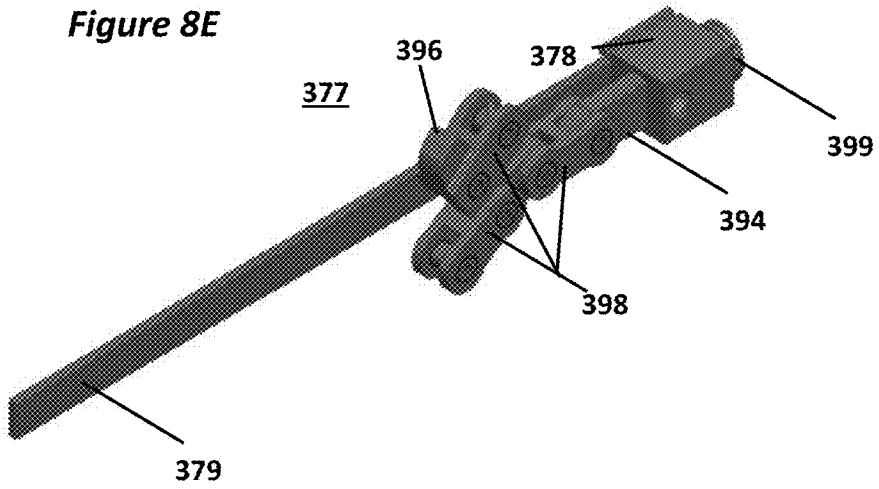
FIG. 8E shows an isometric component view of a latch mechanism according to embodiments of the disclosure.

As the slider 327 comes into contact with the bushing 339, a slider shoulder 390 of a top slider end 327*a* may abut against a bushing shoulder 389 of bushing housing 339*a*. This then results in the bushing 339 lifted from its resting position. In its resting position as generally shown in FIG. 8A, a latch mechanism 377 of the bushing 339 may have a latch piston or rod 379 engaged with a track profile 378 that results in an urging or bias against a bias member 399. The bias member 399 may be stored within a chamber or housing 388 and held in situ via cover or top 395. FIG. 8A (and FIG. 8D) shows the compressed position 399*a* of the bias member 399.

However, as the slider 327 raises the bushing 339, the bias member 399 may move to an expanded or extended position 399*b* in order to urge a cam rod 394 downward, which resultantly shifts or articulates cam links 398 sufficiently enough so that a cam link lip 397 may extend outward into a slider window or opening 396. FIG. 8B in particular shows the cam link lip 397 engaged with a slider window shoulder 327*b*, and thus the slider 327 and the bushing now in the latched position 373.

Once the power swivel 310 moves back down to the first track portion 326*a* and away from the second track portion 326*b*, the latch piston 379 may once again come into contact with the track profile 378. This may then result in raising the piston 379 and (re) compressing the bias member 399 to its compressed position 399*a*. The cam rod 394 may then be retracted, which lets the cam links 395 shift, and unlatches the lip 397. The bushing 339 and the slider 327 are then once again in an unlatched position 373*a*, and the slider 327 and power swivel 310 may continue unabated. The bushing 339 may rest in this position until once again engaged by the slider 327.

Advantages

Embodiments of the disclosure pertain to a track handling device that may be useable for any telescoping mast. The device may include its own telescoping track that scopes up and down with a mast, with no other rig-down requirement needed. The track may lay prone with the mast, with no other rig-down required.

The track handling device may advantageously include a power swivel coupled therewith. The power swivel may be repositioned toward any V-door location. The power swivel is not limited to any particular size, the and track handling device may accommodate a vast range of sizes. The power swivel may be stowed or parked on a support rack coupled with the track handling device.

The track handling device may eliminate or mitigate torque or other forces (incurred via operation of the power swivel) passing into the mast, and instead transfer to the mobile unit.

The track may hang from or couple with a crown of the mast.

In aspects, the track may have portions supported by a link that may beneficially direct some/all torque to the mast crown beams. The portions may be slidingly coupled by plastic wear pads installed in a retention sequence by bolting only the last wear pad. The track handling device may support the Lower track beam being mounted/pinned on clevis lugs welded to several mast c-frame horizontal beams. The device may reacts torque through its linkage into the clevis lug mounts welded to the mast. The device may have a unique geometry allowing infinite, level-adjustment of arm extension or retraction. The moving portion or arm may be contemplated as an 'equilibrating linkage mechanism', which may prevent falling under its own weight as does a simple parallelogram 4-bar linkage.

Heights upwards of forty feet or more are possible for the mast.

The slider may be rotationally coupled to a driver, such as a power swivel or top drive, via a bail pin. The slider may include rollers, bearings, pads, or the like that engage the track. The slider may have a pin or tube configured to capture/secure the bail pin, but yet allow rotational coupling of the slider to the swivel. The pin/tube may be removable and rotates within the slider body (or an extension thereof). The pin/tube may be replaced to match different fits required for other bail pin sizes. The slider may use (welded) wear pad retainer plates with an interlocking style of wear pad mounting within said dolly which require only bolting one (last) wear pad. There may be a bushing with (welded) wear pad retainer plates with an interlocking style of wear pad mounting within said dolly which require only bolting one (last) wear pad.

Embodiments of the present disclosure save time. Even a small savings in drilling or servicing time of individual wells results in an enormous savings on an annual basis.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A torque management system for a drilling or service rig operation comprising:

a mobile carrier unit having a mast support frame;

a mast movably coupled with the mast support frame;

a torque track handling device also coupled with the mast support frame, the track handling device further comprising:

a support frame portion, the support frame portion further comprising an at least one fixed post; and a movable extensible portion coupled with the support frame portion, the movable extensible portion comprising:

a main support arm, the main support arm further comprising a main support arm top end and a main support arm bottom end;

a driver arm movably coupled between the main support arm and the support frame portion; and a follower arm;

a torque track having a first track portion coupled with the main support arm bottom end, and a second track portion coupled with the mast;

a slider configured to move along each of the first track portion and the second track portion, the slider having a power swivel coupler extending therefrom;

a bushing comprising a bushing housing and a latch mechanism, the bushing movably disposed on the second track portion; and a power swivel configured to engage with the power swivel coupler, wherein the track handling device is configured to support both of a track weight load and a power swivel torque load incurred during operation of the power swivel, and wherein at some point when the slider moves along the second track portion, the slider becomes engaged with the latch mechanism in a latched engaged position that comprises at least a portion of the bushing disposed within the bushing housing, and the slider and the bushing mechanically and physically locked together.

2. The torque management system of claim 1, the support frame portion further comprising:

a horizontal spreader coupled with the at least one fixed post;

a first leg extending from the horizontal spreader, and configured with a first hinge mount; and a first latch point extending from the horizontal spreader.

3. The torque management system of claim 2, wherein the power swivel further comprises a torque arm, wherein the power swivel coupler further comprises a coupler housing having a coupler end engaged therein, and wherein the torque arm and the coupler end are held together by a lug pin.

4. The torque management system of claim 1, wherein the bushing comprises a plurality of rollers.

5. The track handling device of claim 4, wherein when the track handling device is in a first position, the main support arm is in a retracted position, and wherein when the track handling device is in a second position, the main support arm is in an extended position.

6. The track handling device of claim 1, wherein when the track handling device is in a first position, the main support arm is in a retracted position, and wherein when the track handling device is in a second position, the main support arm is in an extended position.

7. The track handling device of claim 6, wherein a boot is coupled between main support arm bottom end and the first track portion, the boot having a reference point, whereby a horizontal reference line intersects the reference point when the main support arm is in the retracted position, and wherein the horizontal reference line intersects the reference point within a tolerance of +/−0.5 inches when the main support arm is in the extended position.

8. A torque management system for a drilling operation comprising:

a mobile unit having a support frame;

a mast movably coupled with the support frame;

a track handling device also coupled with the support frame, the track handling device further comprising:

a rigid portion, the rigid portion further comprising an at least one fixed post;

a movable portion coupled with the rigid portion, the movable portion comprising:

a main support arm, the main support arm further comprising a main support arm top end and a main support arm bottom end configured with a boot;

a driver arm movably coupled between the main support arm and the rigid portion; and a follower arm movably coupled between the main support arm top end and the main post top end;

a track having a first track portion coupled with the boot and a second track portion coupled with the mast;

a slider configured to move along each of the first track portion and the second track portion, the slider having a power swivel coupler extending therefrom, the power swivel coupler further comprising a coupler housing having a coupler end engaged therein;

a bushing comprising a latch mechanism having one or more movable parts, the bushing movably disposed on the second track portion; and a power swivel configured to engage with the power swivel coupler, wherein the track handling device is configured to support both of a weight load and a torque incurred during operation of the power swivel, wherein at some point when the slider moves along the second track portion, the slider becomes engaged with the latch mechanism in a latched engaged position that comprises the slider and the bushing mechanically locked together, and wherein in the latched engaged position the coupler end and the power swivel are coupled together by a lug pin.

9. The torque management system of claim 8, the mast further comprising a first mast portion telescopingly engaged with a second mast portion.

10. The torque management system of claim 8, wherein when the track handling device is in a first position, the main support arm is in a retracted position, and wherein when the track handling device is in a second position, the main support arm is in an extended position.

11. The torque management system of claim 10, the rigid portion further comprising:

a horizontal spreader coupled with the at least one fixed post, the at least one fixed post further comprising a main post top end.

12. The torque management system of claim 11, wherein the bushing comprises a plurality of rollers.

13. The torque management system of claim 11, the rigid portion further comprising:

a second leg extending from the horizontal spreader, the second leg configured with a respective hinge mount; and a second latch point extending from the horizontal spreader.

14. The torque management system of claim 11, wherein the movable portion further comprises a turnbuckle coupled between the horizontal spreader and the main support arm.

15. The torque management system of claim 11, wherein in a storage position the power swivel is disposed at a location within the mast.

16. The torque management system of claim 11, wherein the boot comprises a reference point, whereby a horizontal reference line intersects the reference point when the main support arm is in the retracted position, and wherein the horizontal reference line intersects the reference point within a tolerance of +/−0.5 inches when the main support arm is in the extended position.

17. The torque management system of claim 8, wherein the boot comprises a reference point, whereby a horizontal reference line intersects the reference point when the main support arm is in the retracted position, and wherein the horizontal reference line intersects the reference point within a tolerance of +/−0.5 inches when the main support arm is in the extended position during operation of the power swivel.

18. A torque management system for a drilling operation comprising:

a mobile unit having a support frame;

a mast movably coupled with the support frame, the mast having a first mast portion telescopingly engaged with a second mast portion;

a track handling device also coupled with the support frame, the track handling device further comprising:

a rigid portion comprising:

a main post having a main post top end;

a movable portion comprising:

a main support arm, the main support arm further comprising a main support arm top end and a main support arm bottom end;

a driver arm movably coupled between the main support arm and the rigid portion;

a follower arm movably coupled between a main support arm top end and a main post top end; and a boot coupler disposed on the main support arm bottom end;

a track having a first track portion coupled with the boot coupler and a second track portion coupled with the second mast portion, the first track portion telescopingly engaged with the second track portion;

a slider configured to move along each of the first track portion and the second track portion, the slider having a power swivel coupler extending therefrom;

a bushing movably disposed on the second track portion the track, the bushing comprising a latch mechanism having one or more movable parts; and a power swivel, the power swivel having a torque arm configured to engage with the power swivel coupler, wherein at some point when the slider moves along the second track portion, the slider becomes engaged with the latch mechanism in a latched engaged position that comprises the slider and the bushing locked together, wherein in the latched engaged position the power swivel coupler and the torque arm are coupled together by a lug pin, wherein the first track portion has a first track dimension and the second track portion has a second track dimension, and wherein the first track dimension is larger than the second track dimension.

19. The torque management system of claim 18, wherein the boot coupler comprises a reference point, whereby a horizontal reference line intersects the reference point when the main support arm is in the retracted position, and wherein the horizontal reference line intersects the reference point within a tolerance of +/−0.5 inches when the main support arm is in the extended position during operation of the power swivel.

* * * * *